US011118247B2

(12) United States Patent
Gong et al.

(10) Patent No.: US 11,118,247 B2
(45) Date of Patent: Sep. 14, 2021

(54) HIGHLY PROCESSABLE SINGLE CRYSTAL NICKEL ALLOYS

(71) Applicant: QUESTEK INNOVATIONS LLC, Evanston, IL (US)

(72) Inventors: Jiadong Gong, Evanston, IL (US); David R. Snyder, Des Plaines, IL (US); Jason T. Sebastian, Chicago, IL (US)

(73) Assignee: QUESTEK INNOVATIONS LLC, Evanston, IL (US)

( * ) Notice: Subject to any disclaimer, the term of this patent is extended or adjusted under 35 U.S.C. 154(b) by 0 days.

(21) Appl. No.: 16/352,136

(22) Filed: Mar. 13, 2019

(65) Prior Publication Data

US 2020/0048743 A1 Feb. 13, 2020

Related U.S. Application Data

(63) Continuation of application No. 14/723,074, filed on May 27, 2015, now abandoned.
(Continued)

(51) Int. Cl.
*C22C 19/05* (2006.01)
*B22D 21/00* (2006.01)
(Continued)

(52) U.S. Cl.
CPC ..... *C22C 19/057* (2013.01); *B22D 21/005* (2013.01); *B22D 25/02* (2013.01);
(Continued)

(58) Field of Classification Search
CPC ... C22C 1/023; C22F 1/10; F01D 5/28; F05D 2220/323; F05D 2230/21; F05D 2300/17; F05D 2300/607
See application file for complete search history.

(56) References Cited

U.S. PATENT DOCUMENTS 4,039,330 A 8/1977 Shaw
4,392,894 A 7/1983 Pearson et al.
(Continued)

FOREIGN PATENT DOCUMENTS

EP 2465957 A1 6/2016
JP 2011074492 A 4/2011
(Continued)

OTHER PUBLICATIONS

Japanese Patent Office Action for Application No. 2016-569943 dated Dec. 19, 2019 (6 pages, English translation included).
(Continued)

*Primary Examiner* — Nicholas A Wang
(74) *Attorney, Agent, or Firm* — Michael Best & Friedrich LLP

(57) ABSTRACT

Alloys, processes for preparing the alloys, and articles including the alloys are provided. The alloys can include, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities.

16 Claims, 20 Drawing Sheets

Related U.S. Application Data

(60) Provisional application No. 62/003,326, filed on May 27, 2014.

(51) Int. Cl.

| | |
|---|---|
| ***B22D 25/02*** | (2006.01) |
| ***C22C 1/02*** | (2006.01) |
| ***C22F 1/10*** | (2006.01) |
| ***F01D 5/28*** | (2006.01) |

(52) U.S. Cl.

CPC ..... *C22C 1/023* (2013.01); *C22C 19/05* (2013.01); *C22F 1/10* (2013.01); *F01D 5/28* (2013.01); *F05D 2220/323* (2013.01); *F05D 2230/21* (2013.01); *F05D 2300/17* (2013.01); *F05D 2300/607* (2013.01)

(56) References Cited

U.S. PATENT DOCUMENTS

| | | | | |
|---|---|---|---|---|
| 4,719,080 | A | 1/1988 | Duhl et al. | |
| 5,100,616 | A * | 3/1992 | Kawasaki | C22C 19/056 148/410 |
| 5,240,518 | A * | 8/1993 | Wortman | F01D 25/005 148/404 |
| 6,051,083 | A * | 4/2000 | Tamaki | B22D 27/045 148/404 |
| 6,074,602 | A * | 6/2000 | Wukusick | C22C 19/057 148/410 |
| 6,444,057 | B1 | 9/2002 | Darolia et al. | |
| 7,261,783 | B1 | 8/2007 | MacKay et al. | |
| 2002/0062886 | A1* | 5/2002 | Hino | C22F 1/10 148/562 |
| 2010/0034692 | A1* | 2/2010 | Feng | B22D 27/04 420/448 |
| 2010/0135846 | A1 | 6/2010 | Cetel et al. | |
| 2010/0196191 | A1* | 8/2010 | Strangman | C22C 19/056 420/448 |
| 2011/0076180 | A1 | 3/2011 | Suzuki et al. | |
| 2011/0143164 | A1* | 6/2011 | Cetel | C23C 4/02 428/680 |
| 2011/0268602 | A1 | 11/2011 | Wright et al. | |
| 2012/0014832 | A1 | 1/2012 | Harada et al. | |
| 2012/0070303 | A1 | 3/2012 | Aoki et al. | |
| 2012/0273093 | A1 | 11/2012 | Hanlon et al. | |
| 2013/0142637 | A1 | 6/2013 | Harris et al. | |
| 2013/0276939 | A1* | 10/2013 | Ebisu | B22D 11/115 148/555 |

FOREIGN PATENT DOCUMENTS

| | | | |
|---|---|---|---|
| WO | 1993024683 | A1 | 12/1993 |
| WO | 2014070356 | A1 | 5/2014 |

OTHER PUBLICATIONS

Elliott et al., "Directional Solidification of Large Superalloy Castings with Radiation and Liquid-Metal Cooling: A Comparative Assessment," Metallurgical and Materials Transactions A, 2004; 35(10), 3221-3231.

European Patent Office Action for Application No. 15800450.7 dated Jan. 19, 2018 (1 page).

European Patent Office Search Report and Search Opinion for Application No. 15800450.7 dated Jan. 2, 2018 (6 pages).

International Report of Patentability from the International Bureau for Application No. PCT/US2015/032673 dated Nov. 29, 2016 (9 pages).

P. Auburtin, S. L. Cockcroft, A. Mitchell and T. Wang, "Freckle Formation in Superalloys," TMS (The Minerals, Metals & Materials Society), 2000.

PCT Search Report and Written Opinion for Application No. PCT/US15/32673 dated Nov. 27, 2015 (17 pages).

R. Völkl, U. Gatzel, and M. Feller-Kniepmeier, "Measurement of the Lattice Misfit in the Single Crystal Nickel Based Superalloys CMSX-4, SRR99 and SC16 by Convergent Beam Electron Diffraction", Acta mater. vol. 46, No. 12, pp. 4395-4404, 1998.

Yunjiang Wang and Chongyu Wang (2009), "Effect of Alloying Elements on the Elastic Properties of γ-Ni and γ'-Ni3Al from First-principles Calculations", MRS Proceedings, 1224, 1224-FF05-31 doi:10.1557/PROC-1224-FF05-31.

Japanese Patent Office Action for Application No. 2016-569943 dated Feb. 14, 2019 (8 pages, English translation included).

European Patent Office Search Report and Search Opinion for Application No. 15800450.7 dated Apr. 15, 2019 (4 pages).

* cited by examiner

Alloy A: no freckles, no bi-grains, no sliver grains

N5: no freckles, one bi-grain, one sliver grain

Region Description:

| | |
|---|---|
| 1 – G in-range; | R high |
| 2 – G high; | R high |
| 3 – G low; | R in-range |
| 4 – G in-range; | R in-range |
| 5 – G high; | R in-range |

Selected Casting Scenario Map (a) 1275C/2hr (b) 1282C/2hr (c) 1290C/2hr (a) Alloy A Alloy A Rene N5:

| Ion, at.% | Cr % | Ni % | Co % | Al % | Hf % | Mo % | Re % | Ta % | Ti % | W % |
|---|---|---|---|---|---|---|---|---|---|---|
| LEAP1 | 1.71 | 66.76 | 6.63 | 17.28 | 0.05 | 0.61 | 0.10 | 3.13 | 0.38 | 2.81 |
| LEAP2 | 1.92 | 70.34 | 6.64 | 16.97 | 0.08 | 0.85 | 0.07 | 0.72 | 0.42 | 1.79 |
| Prediction | 2.1 | 69.0 | 6.0 | 16.9 | 0.05 | 0.23 | <0.01 | 4.0 | 0.19 | 1.6 |

HIGHLY PROCESSABLE SINGLE CRYSTAL NICKEL ALLOYS

CROSS-REFERENCE TO RELATED APPLICATIONS

This application is a continuation of U.S. Non-Provisional application Ser. No. 14/723,074, filed May 27, 2015, which claims priority to U.S. Provisional Application No. 62/003,326, filed May 27, 2014, the contents of each of which are herein incorporated by reference in their entirety.

STATEMENT OF GOVERNMENT INTEREST

This invention was made with government support under Contract No. DE-SC0009592, awarded by the U.S. Department of Energy. The government has certain rights in the invention.

BACKGROUND

In order to raise the inlet gas temperatures to improve thermal efficiency of industrial gas turbines (IGT), turbine blade materials are required to have superior creep rupture resistance. Ni-base single crystal (SX) blades have higher creep strength in comparison with directionally solidified blades, and are widely used in aerospace engines. However, their use in IGTs, which generally require larger size castings (e.g. 2-3× compared to aerospace), is limited due to casting related defects such as freckling, high angle boundary (HAB) formation, grain nucleation, and shrinkage/porosity; and post-cast defects such as incipient melting and recrystallization during high temperature solution heat treatment. Hence, there exists a market need for a new Ni-based SX superalloy that can be cast effectively as large IGT blade components while maintaining a superior level of creep performance comparable to incumbent advanced SX aero-turbine blade alloys such as ReneN5.

SUMMARY

In one aspect, disclosed is an alloy comprising, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities.

In another aspect, disclosed is an alloy produced by a process comprising: preparing a melt that includes, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities; wherein the melt is molded into a casting; the casting is homogenized by treatment for 2 hours at 1282° C., 2 hours at 1292° C., 6 hours at 1300° C., and 4 hours at 1305° C., with a heating rate of 0.5° C./second between each step, followed by cooling to room temperature in air; and the homogenized casting is tempered by treatment for 4 hours at 1121° C. followed by 20 hours at 871° C.

In another aspect, disclosed is a manufactured article comprising an alloy that includes, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities.

DETAILED DESCRIPTION

Disclosed are nickel-based alloys, methods for making the alloys, and manufactured articles comprising the alloys. A disclosed alloy can be cast as a single crystal alloy, and possess both improved processing and physical properties over existing nickel-based alloys, making it useful for high temperature applications.

The disclosed alloys have improved castability (processability), improved high temperature stability, and improved precipitate strengthening relative to existing nickel-based alloys. These improved properties are the result of a design that incorporates a lower amount of rhenium (e.g., about 1 wt. %) compared to existing single crystal nickel-based alloys. This design leads to a reduction in liquid density difference during solidification (liquid buoyancy) in comparison to existing single crystal nickel-based alloys. In turn, the reduction in liquid buoyancy leads to an improvement in the processability of the alloy, including the realization of high casting yields, freckle resistance, and the absence of grain boundaries.

Figure 1:
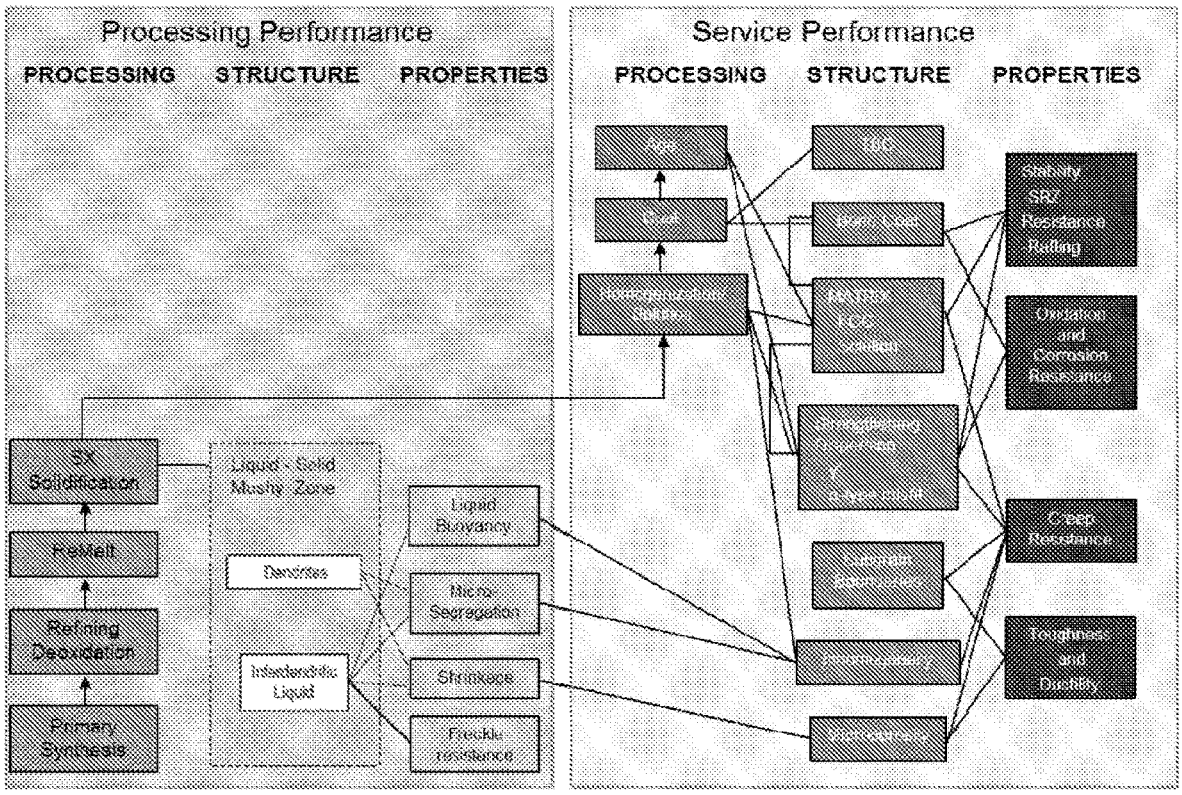
FIG. 1 is a systems-design chart illustrating processing-structure-property relationships of exemplary single crystal nickel-based alloys.

As illustrated in FIG. 1, suitable alloy properties can be selected depending on the desired performance of a manufactured article. A single crystal solidification process is used to achieve the desired alloy structure. In the liquid-solid mushy zone, the interdendritic liquid's properties, such as liquid buoyancy and freckle resistance directly impact the processability of the alloy and the ability to achieve a single crystal structure that is free of defects. The homogenization/solution step after casting is employed to achieve a strengthening phase structure characterized by a low γ/γ' lattice misfit and high γ' phase fraction. This structure leads directly to a manufactured article having high strength and good creep resistance.

It was determined that freckle resistance is related to the liquid density of the alloy during solidification and is based on the Rayleigh number of the alloy, as related by the following equation: $Ra=C\Delta\rho^{0.4}\Delta T^{0.4}[\lambda_1^2(G,R)/G]$. The Rayleigh number, in turn, is related to a value that determines whether or not a freckle will form in the alloy.

A computational model was developed based on liquid buoyancy to determine the freckling formation probability during solidification of the alloy by combining a series of thermodynamic tools and databases. The model and databases were calibrated and validated with a range of existing nickel-based alloys. Representative existing nickel-based alloys are summarized in comparison to the design of the disclosed alloy (Alloy A), below in Table 1.

TABLE 1

| Alloy | Al (%) | Co (%) | Cr (%) | Hf (%) | Mo (%) | Re (%) | Ta (%) | Ti (%) | W (%) | Other (%) |
|---|---|---|---|---|---|---|---|---|---|---|
| PWA1480 | 5 | 5 | 10 | — | — | — | 12 | 1.5 | 4 | |
| PWA1483 | 3.6 | 9 | 12.2 | — | 1.9 | — | 5 | 4.1 | 3.8 | 0.07 C |
| GTD444 | 4.2 | 7.5 | 9.8 | 0.15 | 1.5 | — | 4.8 | 3.5 | 6 | 0.08 C |
| CMSX7 | 5.7 | 10 | 6 | 0.2 | 0.6 | — | 9 | 0.8 | 9 | |
| CMSX8 | 5.7 | 10 | 5.4 | 0.2 | 0.6 | 1.5 | 8 | 0.7 | 8 | |
| PWA1484 | 5.6 | 10 | 5 | 0.1 | 2 | 3 | 8.7 | — | 6 | |
| CMSX4 | 5.6 | 9 | 6.5 | 0.1 | 0.6 | 3 | 6.5 | 1 | 6 | |
| Rene N5 | 6.2 | 7.5 | 7 | 0.15 | 1.5 | 3 | 6.5 | — | 5 | 0.01 Y |
| Alloy A design | 5.9 | 9.1 | 7.1 | 0.1 | 0.9 | 1 | 9.4 | 0.1 | 8 | |

A variety of processing parameters were determined for each alloy. Included were the γ' phase fraction, γ/γ' lattice misfit, and the interfacial energy normalized coarsening rate constant ($K_{MP}$), all calculated at a temperature of 1,000° C. In addition, the reduction in liquid buoyancy at 20% solidification ($\Delta\rho^{0.2}$) and at 40% solidification ($\Delta\rho^{0.4}$) were also calculated. Table 2 shows the values of these parameters for each alloy. The values obtained for the Alloy A design demonstrate low liquid buoyancy differences and a low coarsening rate are preferable for the avoidance of physical defects in the alloy. In addition, modeling of the Alloy A design predicted a high γ' phase fraction in conjunction with a low γ/γ' lattice misfit, allowing the establishment of cuboidal morphology of the γ' precipitates. The design of Alloy A includes a lower amount of rhenium than the other nickel-based alloys that incorporate rhenium. This lower amount led to a prediction of decreased buoyancy difference while maintaining a high γ' phase fraction, relative to the other alloys. The creep behavior of Alloy A is also predicted to be similar to that of alloys containing higher amounts of rhenium. Predicting the creep behavior may be achieved by calculating the Reed Creep Merit Index, a known method for evaluating the creep behavior of alloys (See Zhu, Z.; Hoglund, L.; Larsson, H.; Reed, R. C. *Acta Materialia* 2015, 90, 330-343; and Reed, R. C. et al. *Superalloy* 2012, 197.) The lowered amount of rhenium was also beneficial to the design as it helps reduce the overall cost of producing the alloy.

TABLE 2

| | Database | | | | | Reed Creep |
|---|---|---|---|---|---|---|
| | TCNI6 | | Ni7 + NIST-Ni | PanNickel/TCNI6 | | Merit Index |
| Alloy | $f_\gamma$ (%)* | misfit (%)* | $K_{MP}$* | $\Delta\rho^{0.2}$ | $\Delta\rho^{0.4}$ | ($m^{-2}$ s*$10^{15}$) |
| GTD444 | 64.33 | −0.144 | $1.32 \times 10^{-19}$ | −0.01487 | −0.03388 | — |
| PWA1480 | 63.60 | 0.071 | $1.06 \times 10^{-19}$ | −0.00465 | −0.01120 | — |
| PWA1483 | 47.05 | −0.122 | $1.22 \times 10^{-19}$ | −0.00932 | −0.02178 | 2.77 |
| PWA1484 | 56.05 | −0.243 | $5.97 \times 10^{-20}$ | −0.01200 | −0.02221 | 5.68 |
| Rene N5 | 58.80 | −0.332 | $7.17 \times 10^{-20}$ | −0.02192 | −0.04558 | 3.82 |
| CMSX4 | 57.84 | −0.226 | $6.00 \times 10^{-20}$ | −0.02642 | −0.05875 | 4.51 |
| CMSX7 | 61.67 | −0.253 | $9.83 \times 10^{-20}$ | −0.01167 | −0.02728 | — |
| CMSX8 | 59.83 | −0.019 | $6.33 \times 10^{-20}$ | −0.01912 | −0.04292 | — |
| Alloy A | 59.25 | −0.271 | $6.59 \times 10^{-20}$ | −0.01037 | −0.02210 | 3.97 |

*$f_\gamma$, γ/γ' lattice misfit, and $K_{MP}$, were calculated at a temperature of 1,000° C.

Also modeled and predicted were the key equilibrium temperatures of the design of Alloy A in comparison to the existing nickel-based alloys (Table 3). This heat treatment window prediction resulted in a homogenizing window (difference between solvus and solidus) for the Alloy A design of between 5-20° C.

TABLE 3

| | Database | | | | | |
|---|---|---|---|---|---|---|
| | TCNI6 | | | Ni7 | | |
| Alloy | Solvus (° C.) | Solidus (° C.) | Liquidus (° C.) | Solvus (° C.) | Solidus (° C.) | Liquidus (° C.) |
| PWA1484 | 1290.5 | 1339.0 | 1391.0 | 1278.5 | 1328.6 | 1381.9 |
| CMSX4 | 1270.0 | 1338.1 | 1389.9 | 1257.4 | 1333.7 | 1380.0 |
| Rene N5 | 1307.0 | 1335.0 | 1393.5 | 1271.4 | 1335.2 | 1380.0 |
| CMSX7 | 1298.3 | 1300.5 | 1376.0 | 1287.1 | 1301.7 | 1359.1 |
| CMSX8 | 1293.8 | 1315.8 | 1384.8 | 1285.0 | 1319.4 | 1370.0 |
| Alloy A | 1310.7 | 1315.6 | 1373.2 | 1281.0 | 1303.0 | 1358.9 |

Taken together, the comprehensive modeling of Alloy A's design provided guidance for the creation of a new single crystal nickel-based alloy. Correct prediction of processing parameters resulted in formation of a single crystal nickel-based alloy, free of defects, with improved processability over existing alloys. The alloy also possesses physical properties that allow it to be used in high temperature applications that require high strength, high temperature stability, and high creep resistance.

I. Definitions of Terms

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

The term "creep resistance," as used herein, may refer to the ability to resist any kind of deformation when under a load over an extended period of time.

The term "freckle," as used herein, may refer to a casting defect due to convective instability during solidification.

The term "casting defect," as used herein, may refer to a range of undesirable defects in single crystal alloy castings. Common casting defects include freckles, grain defects (such as slivers and spurious grains), and porosity.

The term "liquid buoyancy," as used herein, may refer to an upward force exerted by a fluid that results from a difference in pressure; and may be an indication of the density of the liquid at different stages of the solidification.

The term "γ/γ' lattice misfit," as used herein, may refer to the situation where two phases featuring different lattice constants are brought together; in general, lattice misfit is the percentage of the difference in lattice constants.

The term "γ' phase fraction," as used herein, may refer to the fraction of the γ' phase with respect to the whole system in moles.

The term "solvus," as used herein, may refer to a line (binary system) or surface (ternary system) on a phase diagram which separates a homogeneous solid solution from a field of several phases which may form by exsolution or incongruent melting. Solvus may refer to solvus of the γ' phase.

The term "solidus," as used herein, may refer to the temperature below which a mixture is completely solid.

The term "liquidus," as used herein, may refer to the temperature above which a material is completely liquid, and the maximum temperature at which crystals can co-exist with the melt in thermodynamic equilibrium.

The term "interfacial energy normalized coarsening rate constant," as used herein, may refer to the coarsening rate constant derived by the Morral and Purdy model with normalization to interfacial energy and molar volume. It is an indication of how fast the precipitates will coarsen at a given temperature. The bigger the number, the faster the precipitates coarsen.

The term "topologically close-packed phases," as used herein, may refer to detrimental phases formed in superalloys when more than trace amounts are present, which usually are platelike or needlelike phases such as σ and Laves.

The term "cuboidal morphology," as used herein, may refer to typical precipitation-hardened nickel-base superalloy microstructures as the γ' precipitates evolved from spheroidal to cuboidal.

The term "G," as used herein, may refer to the local thermal gradient of the specific location during the solidification.

The term "$\lambda_1$," as used herein, may refer to the spacing between the primary dendrite arms in length.

As used in the specification and the appended claims, the singular forms "a," "an" and "the" include plural references unless the context clearly dictates otherwise. The terms "comprise(s)," "include(s)," "having," "has," "can," "contain(s)," and variants thereof, as used herein, are intended to be open-ended transitional phrases, terms, or words that do not preclude the possibility of additional acts or structures. The present disclosure also contemplates other embodiments "comprising," "consisting of" and "consisting essentially of," the embodiments or elements presented herein, whether explicitly set forth or not.

The conjunctive term "or" includes any and all combinations of one or more listed elements associated by the conjunctive term. For example, the phrase "an apparatus comprising A or B" may refer to an apparatus including A where B is not present, an apparatus including B where A is not present, or an apparatus where both A and B are present. The phrases "at least one of A, B, . . . and N" or "at least one of A, B, . . . N, or combinations thereof" are defined in the broadest sense to mean one or more elements selected from the group comprising A, B, . . . and N, that is to say, any combination of one or more of the elements A, B, . . . or N including any one element alone or in combination with one or more of the other elements which may also include, in combination, additional elements not listed.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

Any recited range described herein is to be understood to encompass and include all values within that range, without the necessity for an explicit recitation.

II. Alloys

The disclosed alloys may comprise aluminum, carbon, cobalt, chromium, hafnium, molybdenum, rhenium, tantalum, titanium, tungsten, and nickel, along with incidental elements and impurities.

The alloys may comprise, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities. It is understood that the alloys described herein may consist only of the above-mentioned constituents or may consist essentially of such constituents, or in other embodiments, may include additional constituents.

The alloys may comprise, by weight, about 5% to about 7% aluminum, 0% to about 0.2% carbon, about 8% to about 10% cobalt, about 6% to about 8% chromium, about 0.01% to about 0.2% hafnium, about 0.5% to about 2% molybdenum, 0% to about 1.5% rhenium, about 8.5% to about 10.5% tantalum, about 0.01% to about 0.2% titanium, and about 7% to about 9% tungsten, the balance essentially nickel and incidental elements and impurities. It is understood that the alloys described herein may consist only of the above-mentioned constituents or may consist essentially of such constituents, or in other embodiments, may include additional constituents.

The alloys may comprise, by weight, about 5.5% to about 6.5% aluminum, about 8.5% to about 9.5% cobalt, about 6.5% to about 7.5% chromium, about 0.05% to about 0.15% hafnium, about 0.6% to about 1.2% molybdenum, about 0.8% to about 1.2% rhenium, about 9% to about 10% tantalum, about 0.05% to about 0.15% titanium, and about 7.5% to about 8.5% tungsten, the balance essentially nickel and incidental elements and impurities.

The alloys may comprise, by weight, about 4% to about 7% aluminum, about 5% to about 7% aluminum, about 5.5% to about 7% aluminum, about 5.5% to about 6.5% aluminum, about 5.5% to about 6% aluminum, about 5.6% to about 6% aluminum, about 5.7% to about 6% aluminum, about 5.8% to about 6% aluminum, about 5.9% to about 6% aluminum, about 5.8% to about 5.9% aluminum, or about 5.85% to about 5.9% aluminum. The alloys may comprise, by weight, 5% to 7% aluminum, 5.5% to 7% aluminum, 5.5% to 6.5% aluminum, 5.5% to 6% aluminum, 5.6% to 6% aluminum, 5.7% to 6% aluminum, 5.8% to 6% aluminum, 5.9% to 6% aluminum, 5.8% to 5.9% aluminum, or 5.85% to 5.9% aluminum. The alloys may comprise, by weight, 4.0%, 4.1%, 4.2%, 4.3%, 4.4%, 4.5%, 4.6%, 4.7%, 4.8%, 4.9%, 5.0%, 5.05%, 5.1%, 5.15%, 5.2%, 5.25%, 5.3%, 5.35%, 5.4%, 5.45%, 5.5%, 5.55%, 5.6%, 5.65%, 5.7%, 5.75%, 5.8%, 5.81%, 5.82%, 5.83%, 5.84%, 5.85%, 5.86%, 5.87%, 5.88%, 5.89%, 5.9%, 5.91%, 5.92%, 5.93%, 5.94%, 5.95%, 5.96%, 5.97%, 5.98%, 5.99%, 6.0%, 6.05%, 6.1%, 6.15%, 6.2%, 6.25%, 6.3%, 6.35%, 6.4%, 6.45%, 6.5%, 6.55%, 6.6%, 6.65%, 6.7%, 6.75%, 6.8%, 6.85%, 6.9%, 6.95%, or 7.0% aluminum. The alloys may comprise, by weight, about 4% aluminum, about 5% aluminum, about 5.5% aluminum, about 5.8% aluminum, about 5.89% aluminum, about 5.9% aluminum, about 6% aluminum, about 6.1% aluminum, about 6.5% aluminum, or about 7% aluminum.

The alloys may comprise, by weight, 0% to about 0.2% carbon, about 0.01% to about 0.2% carbon, 0% to about 0.1% carbon, about 0.01% to about 0.1% carbon, or about 0.1% to about 0.2% carbon. The alloys may comprise, by weight, 0% to 0.2% carbon, 0.01% to 0.2% carbon, 0% to 0.1% carbon, 0.01% to 0.1% carbon, or 0.1% to 0.2% carbon. The alloys may comprise, by weight, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2%, carbon. The alloys may comprise, by weight, about 0.01% carbon, about 0.1% carbon, about 0.12% carbon, about 0.14% carbon, about 0.15% carbon, or about 0.2% carbon.

The alloys may comprise, by weight, about 7% to about 11% cobalt, about 8% to about 10% cobalt, about 8.5% to about 10% cobalt, about 8.5% to about 9.5% cobalt, about 8.7% to about 9.3% cobalt, about 8.8% to about 9.2% cobalt, about 8.9% to about 9.1% cobalt, about 8.95% to about 9.15% cobalt, about 9% to about 9.15% cobalt, or about 9% to about 9.1% cobalt. The alloys may comprise, by weight, 7% to 11% cobalt, 8% to 10% cobalt, 8.5% to 10% cobalt, 8.5% to 9.5% cobalt, 8.7% to 9.3% cobalt, 8.8% to 9.2% cobalt, 8.9% to 9.1% cobalt, 8.95% to 9.15% cobalt, 9% to 9.15% cobalt, or 9% to 9.1% cobalt. The alloys may comprise, by weight, 7.0%, 7.1%, 7.2%, 7.3%, 7.4%, 7.5%, 7.6%, 7.7%, 7.8%, 7.9%, 8.0%, 8.05%, 8.1%, 8.15%, 8.2%, 8.25%, 8.3%, 8.35%, 8.4%, 8.45%, 8.5%, 8.55%, 8.6%, 8.65%, 8.7%, 8.75%, 8.8%, 8.85%, 8.9%, 8.91%, 8.92%, 8.93%, 8.94%, 8.95%, 8.96%, 8.97%, 8.98%, 8.99%, 9.0%, 9.01%, 9.02%, 9.03%, 9.04%, 9.05%, 9.06%, 9.07%, 9.08%, 9.09%, 9.1%, 9.15%, 9.2%, 9.25%, 9.3%, 9.35%, 9.4%, 9.45%, 9.5%, 9.55%, 9.6%, 9.65%, 9.7%, 9.75%, 9.8%, 9.85%, 9.9%, 9.95%, 10.0%, 10.1%, 10.2%, 10.3%, 10.4%, 10.5%, 10.6%, 10.7%, 10.8%, 10.9%, or 11.0% cobalt. The alloys may comprise, by weight, about 7% cobalt, 8% cobalt, about 8.5% cobalt, about 8.8% cobalt, about 8.9% cobalt, about 9% cobalt, about 9.04% cobalt, about 9.1% cobalt, about 9.2% cobalt, about 9.5% cobalt, about 10% cobalt, or about 11% cobalt.

The alloys may comprise, by weight, about 5% to about 9% chromium, about 6% to about 8% chromium, about 6.5% to about 8% chromium, about 6.5% to about 7.5% chromium, about 6.7% to about 7.3% chromium, about 6.8% to about 7.2% chromium, about 6.9% to about 7.1% chromium, about 6.95% to about 7.15% chromium, about 7% to about 7.15% chromium, or about 7% to about 7.1% chromium. The alloys may comprise, by weight, 6% to 8% chromium, 6.5% to 8% chromium, 6.5% to 7.5% chromium, 6.7% to 7.3% chromium, 6.8% to 7.2% chromium, 6.9% to 7.1% chromium, 6.95% to 7.15% chromium, 7% to 7.15% chromium, or 7% to 7.1% chromium. The alloys may comprise, by weight, 5.0%, 5.1%, 5.2%, 5.3%, 5.4%, 5.5%, 5.6%, 5.7%, 5.8%, 5.9%, 6.0%, 6.05%, 6.1%, 6.15%, 6.2%, 6.25%, 6.3%, 6.35%, 6.4%, 6.45%, 6.5%, 6.55%, 6.6%, 6.65%, 6.7%, 6.75%, 6.8%, 6.85%, 6.9%, 6.91%, 6.92%, 6.93%, 6.94%, 6.95%, 6.96%, 6.97%, 6.98%, 6.99%, 7.0%, 7.01%, 7.02%, 7.03%, 7.04%, 7.05%, 7.06%, 7.07%, 7.08%, 7.09%, 7.1%, 7.15%, 7.2%, 7.25%, 7.3%, 7.35%, 7.4%, 7.45%, 7.5%, 7.55%, 7.6%, 7.65%, 7.7%, 7.75%, 7.8%, 7.85%, 7.9%, 7.95%, 8.0%, 8.1%, 8.2%, 8.3%, 8.4%, 8.5%, 8.6%, 8.7%, 8.8%, 8.9%, or 9.0% chromium. The alloys may comprise, by weight, about 5% chromium, about 6% chromium, about 6.5% chromium, about 6.8% chromium, about 6.9% chromium, about 7% chromium, about 7.03% chromium, about 7.1% chromium, about 7.2% chromium, about 7.5% chromium, about 8% chromium, or about 9% chromium.

The alloys may comprise, by weight, about 0.01% to about 0.2% hafnium, about 0.1% to about 0.2% hafnium, about 0.01% to about 0.1% hafnium, about 0.05% to about 0.15% hafnium, about 0.08% to about 0.12% hafnium, or about 0.09% to about 0.11% hafnium. The alloys may comprise, by weight, 0.01% to 0.2% hafnium, 0.1% to 0.2% hafnium, 0.01% to 0.1% hafnium, 0.05% to 0.15% hafnium, 0.08% to 0.12% hafnium, or 0.09% to 0.11% hafnium. The alloys may comprise, by weight, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19% or 2.0% hafnium. The alloys may comprise, by weight, about 0.01% hafnium, about 0.1% hafnium, about 0.15% hafnium, or about 0.2% hafnium.

The alloys may comprise, by weight, about 0.5% to about 2% molybdenum, about 0.6% to about 2% molybdenum, about 0.6% to about 1.5% molybdenum, about 0.6% to about 1.2% molybdenum, about 0.7% to about 1.1% molybdenum, about 0.8% to about 1.0% molybdenum, about 0.85% to about 0.95% molybdenum, or about 0.9% to about 1.0% molybdenum. The alloys may comprise, by weight, 0.5% to 2% molybdenum, 0.6% to 2% molybdenum, 0.6% to 1.5% molybdenum, 0.6% to 1.2% molybdenum, 0.7% to 1.1% molybdenum, 0.8% to 1.0% molybdenum, 0.85% to 0.95% molybdenum, or 0.9% to 1.0% molybdenum. The alloys may comprise, by weight, 0.5%, 0.6%, 0.7%, 0.8%, 0.81%, 0.82%, 0.83%, 0.84%, 0.85%, 0.86%, 0.87%, 0.88%, 0.89%, 0.9%, 0.91%, 0.92%, 0.93%, 0.94%, 0.95%, 0.96%, 0.97%, 0.98%, 0.99%, 1.0%, 1.1%, 1.2%, 1.3%, 1.4%, 1.5%, 1.6%, 1.7%, 1.8%, 1.9%, or 2% molybdenum. The alloys may comprise, by weight, about 0.5% molybdenum, about 0.6% molybdenum, about 0.8% molybdenum, about 0.9% molybdenum, about 0.91% molybdenum, about 1% molybdenum, about 1.1% molybdenum, about 1.2% molybdenum, about 1.5% molybdenum, or about 2% molybdenum.

The alloys may comprise, by weight, 0% to about 1.5% rhenium, about 0.1% to about 1.5% rhenium, about 0.5% to about 1.5% rhenium, about 0.6% to about 1.2% rhenium, about 0.7% to about 1.1% rhenium, about 0.8% to about 1.2% rhenium, about 0.9% to about 1.1% rhenium, or about 0.95% to about 1.05% rhenium. The alloys may comprise, by weight, 0% to 1.5% rhenium, 0.1% to 1.5% rhenium, 0.5% to 1.5% rhenium, 0.6% to 1.2% rhenium, 0.7% to 1.1% rhenium, 0.8% to 1.2% rhenium, 0.9% to 1.1% rhenium, or 0.95% to 1.05% rhenium. The alloys may comprise, by weight, 0.1%, 0.2%, 0.3%, 0.4%, 0.5%, 0.6%, 0.7%, 0.8%, 0.9%, 0.91%, 0.92%, 0.93%, 0.94%, 0.95%, 0.96%, 0.97%, 0.98%, 0.99%, 1.0%, 1.01%, 1.02%, 1.03%, 1.04%, 1.05%, 1.06%, 1.07%, 1.08%, 1.09%, 1.1%, 1.2%, 1.3%, 1.4%, or 1.5% rhenium. The alloys may comprise, by weight, about 0.5% rhenium, about 0.6% rhenium, about 0.8% rhenium, about 0.9% rhenium, about 1% rhenium, about 1.03% rhenium, about 1.05% rhenium, about 1.1% rhenium, about 1.2% rhenium, or about 1.5% rhenium.

The alloys may comprise, by weight, about 8% to about 10.5% tantalum, about 8.5% to about 10.5% tantalum, about 8.5% to about 10% tantalum, about 8.5% to about 9.5% tantalum, about 9% to about 10% tantalum, about 9.2% to about 9.8% tantalum, or about 9.4% to about 9.6% tantalum. The alloys may comprise, by weight, 8% to 10.5% tantalum, 8.5% to 10.5% tantalum, 8.5% to 10% tantalum, 8.5% to 9.5% tantalum, 9% to 10% tantalum, 9.2% to 9.8% tantalum, or 9.4% to 9.6% tantalum. The alloys may comprise, by weight, 8.0%, 8.1%, 8.2%, 8.3%, 8.4%, 8.5%, 8.6%, 8.7%, 8.8%, 8.9%, 9%, 9.1%, 9.2%, 9.3%, 9.4%, 9.41%, 9.42%, 9.43%, 9.44%, 9.45%, 9.46%, 9.47%, 9.48%, 9.49%, 9.5%, 9.51%, 9.52%, 9.53%, 9.54%, 9.55%, 9.56%, 9.57%, 9.58%, 9.59%, 9.6%, 9.7%, 9.8%, 9.9%, 10%, 10.1%, 10.2%, 10.3%, 10.4%, or 10.5% tantalum. The alloys may comprise, by weight, about 8.0% tantalum, about 8.5% tantalum, about 9% tantalum, about 9.4% tantalum, about 9.5% tantalum, about 9.6% tantalum, about 10% tantalum, or about 10.5% tantalum.

The alloys may comprise, by weight, about 0.01% to about 0.5% titanium, about 0.01% to about 0.2% titanium, about 0.1% to about 0.2% titanium, about 0.01% to about 0.15% titanium, about 0.05% to about 0.15% titanium, about 0.08% to about 0.12% titanium, about 0.09% to about 0.11% titanium, or about 0.1% to about 0.12% titanium. The alloys may comprise, by weight, 0.01% to 0.5% titanium, 0.01% to 0.2% titanium, 0.1% to 0.2% titanium, 0.01% to 0.15% titanium, 0.05% to 0.15% titanium, 0.08% to 0.12% titanium, 0.09% to 0.11% titanium, or about 0.1% to about 0.12% titanium. The alloys may comprise, by weight, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%. 0.2%, 0.3%, 0.4%, or 0.5% titanium. The alloys may comprise, by weight, about 0.01% titanium, about 0.1% titanium, about 0.11% titanium, about 0.15% titanium, about 0.2% titanium, or about 0.5% titanium.

The alloys may comprise, by weight, about 6% to about 10% tungsten, about 7% to about 9% tungsten, about 7.5% to about 9% tungsten, about 7.5% to about 8.5% tungsten, about 7.5% to about 8% tungsten, about 7.6% to about 8% tungsten, about 7.7% to about 8% tungsten, about 7.7% to about 7.9% tungsten, or about 7.8% to about 7.9% tungsten. The alloys may comprise, by weight, 6% to 10% tungsten, 7% to 9% tungsten, 7.5% to 9% tungsten, 7.5% to 8.5% tungsten, 7.5% to 8% tungsten, 7.6% to 8% tungsten, 7.7% to 8% tungsten, 7.7% to 7.9% tungsten, or 7.8% to 7.9% tungsten. The alloys may comprise, by weight, 6.0%, 6.1%, 6.2%, 6.3%, 6.4%, 6.5%, 6.6%, 6.7%, 6.8%, 6.9%, 7.0%, 7.05%, 7.1%, 7.15%, 7.2%, 7.25%, 7.3%, 7.35%, 7.4%, 7.45%, 7.5%, 7.55%, 7.6%, 7.65%, 7.7%, 7.71%, 7.72%, 7.73%, 7.74%, 7.75%, 7.76%, 7.77%, 7.78%, 7.79%, 7.8%, 7.81%, 7.82%, 7.83%, 7.84%, 7.85%, 7.86%, 7.87%, 7.88%, 7.89%, 7.9%, 7.91%, 7.92%, 7.93%, 7.94%, 7.95%, 7.96%, 7.97%, 7.98%, 7.99%, 8.0%, 8.01%, 8.02%, 8.03%, 8.04%, 8.05%, 8.06%, 8.07%, 8.08%, 8.09%, 8.1%, 8.15%, 8.2%, 8.25%, 8.3%, 8.35%, 8.4%, 8.45%, 8.5%, 8.55%, 8.6%, 8.65%, 8.7%, 8.75%, 8.8%, 8.85%, 8.9%, 8.95%, 9.0%, 9.1%, 9.2%, 9.3%, 9.4%, 9.5%, 9.6%, 9.7%, 9.8%, 9.9%, or 10.0% tungsten. The alloys may comprise, by weight, about 6% tungsten, about 7% tungsten, about 7.5% tungsten, about 7.8% tungsten, about 7.81% tungsten, about 7.9% tungsten, about 8% tungsten, about 8.1% tungsten, about 8.5% tungsten, about 9% tungsten, or about 10% tungsten.

The alloys may comprise, by weight, a balance of nickel and incidental elements and impurities. The term "incidental elements and impurities," may include one or more of carbon, boron, iron, niobium, ruthenium, lanthanum, zirconium, manganese, silicon, copper, vanadium, cerium, magnesium, and nitrogen.

The incidental elements and impurities may include one or more of carbon, boron, iron, niobium, ruthenium, lanthanum, zirconium, manganese, silicon, copper, vanadium, cerium, magnesium, and nitrogen.

The incidental elements and impurities may include one or more of carbon (e.g., maximum 0.4%), boron (e.g., maximum 0.05%), iron (e.g., maximum 2%), niobium (e.g., maximum 2%), ruthenium (e.g., maximum 2%), lanthanum (e.g., maximum 2%), zirconium (e.g., maximum 2%), manganese (e.g., maximum 2%), silicon (e.g., maximum 2%), copper (e.g., maximum 2%), vanadium (e.g., maximum 2%), cerium (e.g., maximum 2%), magnesium (e.g., maximum 2%), and nitrogen (e.g., maximum 0.02%).

The alloys may comprise, by weight, 5.9% aluminum, 9% cobalt, 7% chromium, 0.1% hafnium, 0.9% molybdenum, 1% rhenium, 9.5% tantalum, 0.11% titanium, and 7.8% tungsten, the balance essentially nickel and incidental elements and impurities. The incidental elements and impurities may include one or more of carbon (e.g., maximum 0.4%), boron (e.g., maximum 0.05%), iron (e.g., maximum 2%), niobium (e.g., maximum 2%), ruthenium (e.g., maximum 2%), lanthanum (e.g., maximum 2%), zirconium (e.g., maximum 2%), manganese (e.g., maximum 2%), silicon (e.g., maximum 2%), copper (e.g., maximum 2%), vanadium (e.g., maximum 2%), cerium (e.g., maximum 2%), magnesium (e.g., maximum 2%), and nitrogen (e.g., maximum 0.02%).

The alloys may consist of, by weight, 5.9% aluminum, 9% cobalt, 7% chromium, 0.1% hafnium, 0.9% molybdenum, 1% rhenium, 9.5% tantalum, 0.11% titanium, and 7.8% tungsten, the balance essentially nickel and incidental elements and impurities. The incidental elements and impurities may include one or more of carbon (e.g., maximum 0.4%), boron (e.g., maximum 0.05%), iron (e.g., maximum 2%), niobium (e.g., maximum 2%), ruthenium (e.g., maximum 2%), lanthanum (e.g., maximum 2%), zirconium (e.g., maximum 2%), manganese (e.g., maximum 2%), silicon (e.g., maximum 2%), copper (e.g., maximum 2%), vanadium (e.g., maximum 2%), cerium (e.g., maximum 2%), magnesium (e.g., maximum 2%), and nitrogen (e.g., maximum 0.02%).

In certain embodiments in which enhanced oxidation resistance and/or enhanced thermal barrier coating life are desired, the alloys may comprise additional elements. The additional elements may include one or more of lanthanum and yttrium. The alloys may comprise, by weight, 0% to about 0.5% lanthanum. The alloys may comprise, by weight, 0% to about 0.5% yttrium.

In certain embodiments for large industrial gas turbine single crystal applications in which low angle boundary strengthening is desired, the alloys may comprise boron. The alloys may comprise, by weight, 0% to about 0.5% boron.

The alloys may be in the form of a casting as a single crystal. The alloys may be essentially free of grain boundaries. The alloys may be essentially free of high angle grain boundaries. The alloys may be essentially free of low angle grain boundaries. The alloys may be essentially free of sliver grains. The alloys may be essentially free of bigrains. In certain embodiments, the alloys do not comprise grain boundaries. In certain embodiments, the alloys do not comprise high angle grain boundaries. In certain embodiments, the alloys do not comprise low angle grain boundaries. In certain embodiments, the alloys do not comprise sliver grains. In certain embodiments, the alloys do not comprise bigrains.

The alloys may be essentially free of freckles. In certain embodiments, the alloys do not comprise freckles.

The alloys may have a $G/\lambda_1^2$ value, at 20% solidification of the alloy, of 2000° C./cm$^3$ to 10000° C./cm$^3$, 2000° C./cm$^3$ to 8000° C./cm$^3$, 2500° C./cm$^3$ to 10000° C./cm$^3$, 2500° C./cm$^3$ to 8000° C./cm$^3$, 3000° C./cm$^3$ to 10000° C./cm$^3$, 3500° C./cm$^3$ to 8000° C./cm$^3$, 3500° C./cm$^3$ to 10000° C./cm$^3$, 4000° C./cm$^3$ to 10000° C./cm$^3$, 4000° C./cm$^3$ to 8000° C./cm$^3$, 4500° C./cm$^3$ to 10000° C./cm$^3$, 4500° C./cm$^3$ to 8000° C./cm$^3$, 5000° C./cm$^3$ to 10000° C./cm$^3$, 5500° C./cm$^3$ to 8000° C./cm$^3$, 5500° C./cm$^3$ to 10000° C./cm$^3$, 6000° C./cm$^3$ to 10000° C./cm$^3$, 6500° C./cm$^3$ to 8000° C./cm$^3$, 6500° C./cm$^3$ to 10000° C./cm$^3$, 7000° C./cm$^3$ to 10000° C./cm$^3$, 7000° C./cm$^3$ to 8000° C./cm$^3$, 7500° C./cm$^3$ to 10000° C./cm$^3$, 7500° C./cm$^3$ to 8000° C./cm$^3$, 8000° C./cm$^3$ to 10000° C./cm$^3$, 8500° C./cm$^3$ to 10000° C./cm$^3$, 9000° C./cm$^3$ to 10000° C./cm$^3$, or 9500° C./cm$^3$ to 10000° C./cm$^3$. The alloys may have a $G/\lambda_1^2$ value, at 20% solidification of the alloy, of at least 2000° C./cm$^3$, at least 2500° C./cm$^3$, at least 3000° C./cm$^3$, at least 3500° C./cm$^3$, at least 4000° C./cm$^3$, at least 4500° C./cm$^3$, at least 5000° C./cm$^3$, at least 5500° C./cm$^3$, at least 6000° C./cm$^3$, at least 6500° C./cm$^3$, at least 7000° C./cm$^3$, at least 7500° C./cm$^3$, at least 8000° C./cm$^3$, at least 8500° C./cm$^3$, at least 9000° C./cm$^3$, at least 9500° C./cm$^3$, at least 10000° C./cm$^3$, at least 11000° C./cm$^3$, at least 12000° C./cm$^3$, at least 13000° C./cm$^3$, at least 14000° C./cm$^3$, or at least 15000° C./cm$^3$. The alloys may have a $G/\lambda_1^2$ value, at 20% solidification of the alloy, of 2000° C./cm$^3$, 2100° C./cm$^3$, 2200° C./cm$^3$, 2300° C./cm$^3$, 2400° C./cm$^3$, 2500° C./cm$^3$, 2600° C./cm$^3$, 2700° C./cm$^3$, 2800° C./cm$^3$, 2900° C./cm$^3$, 3000° C./cm$^3$, 3100° C./cm$^3$, 3200° C./cm$^3$, 3300° C./cm$^3$, 3400° C./cm$^3$, 3500° C./cm$^3$, 3600° C./cm$^3$, 3700° C./cm$^3$, 3800° C./cm$^3$, 3900° C./cm$^3$, 4000° C./cm$^3$, 4100° C./cm$^3$, 4200° C./cm$^3$, 4300° C./cm$^3$, 4400° C./cm$^3$, 4500° C./cm$^3$, 4600° C./cm$^3$, 4700° C./cm$^3$, 4800° C./cm$^3$, 4900° C./cm$^3$, 5000° C./cm$^3$, 5100° C./cm$^3$, 5200° C./cm$^3$, 5300° C./cm$^3$, 5400° C./cm$^3$, 5500° C./cm$^3$, 5600° C./cm$^3$, 5700°

C./cm$^3$, 5800° C./cm$^3$, 5900° C./cm$^3$, 6000° C./cm$^3$, 6100° C./cm$^3$, 6200° C./cm$^3$, 6300° C./cm$^3$, 6400° C./cm$^3$, 6500° C./cm$^3$, 6600° C./cm$^3$, 6700° C./cm$^3$, 6800° C./cm$^3$, 6900° C./cm$^3$, 7000° C./cm$^3$, 7100° C./cm$^3$, 7200° C./cm$^3$, 7300° C./cm$^3$, 7400° C./cm$^3$, 7500° C./cm$^3$, 7600° C./cm$^3$, 7700° C./cm$^3$, 7800° C./cm$^3$, 7900° C./cm$^3$, 8000° C./cm$^3$, 8100° C./cm$^3$, 8200° C./cm$^3$, 8300° C./cm$^3$, 8400° C./cm$^3$, 8500° C./cm$^3$, 8600° C./cm$^3$, 8700° C./cm$^3$, 8800° C./cm$^3$, 8900° C./cm$^3$, 9000° C./cm$^3$, 9100° C./cm$^3$, 9200° C./cm$^3$, 9300° C./cm$^3$, 9400° C./cm$^3$, 9500° C./cm$^3$, 9600° C./cm$^3$, 9700° C./cm$^3$, 9800° C./cm$^3$, 9900° C./cm$^3$, 10000° C./cm$^3$, 11000° C./cm$^3$, 12000° C./cm$^3$, 13000° C./cm$^3$, 14000° C./cm$^3$, or 15000° C./cm$^3$. The alloys may have a $G/\lambda_1^2$ value, at 20% solidification of the alloy, of about 2000° C./cm$^3$, about 2500° C./cm$^3$, about 3000° C./cm$^3$, about 3500° C./cm$^3$, about 4000° C./cm$^3$, about 4500° C./cm$^3$, about 5000° C./cm$^3$, about 5500° C./cm$^3$, about 6000° C./cm$^3$, about 6500° C./cm$^3$, about 7000° C./cm$^3$, about 7500° C./cm$^3$, about 8000° C./cm$^3$, about 8500° C./cm$^3$, about 9000° C./cm$^3$, about 9500° C./cm$^3$, about 10000° C./cm$^3$, about 11000° C./cm$^3$, about 12000° C./cm$^3$, about 13000° C./cm$^3$, about 14000° C./cm$^3$, or about 15000° C./cm$^3$.

The alloys may have a reduction in liquid density, at 20% solidification of the alloy, of 0 to 0.025 g/cm$^3$, 0 to 0.02 g/cm$^3$, 0 to 0.015 g/cm$^3$, 0 to 0.011 g/cm$^3$, 0 to 0.01 g/cm$^3$, or 0 to 0.005 g/cm$^3$. The alloys may have a reduction in liquid density, at 20% solidification of the alloy, of 0.025 g/cm$^3$, 0.024 g/cm$^3$, 0.023 g/cm$^3$, 0.022 g/cm$^3$, 0.021 g/cm$^3$, 0.02 g/cm$^3$, 0.019 g/cm$^3$, 0.018 g/cm$^3$, 0.017 g/cm$^3$, 0.016 g/cm$^3$, 0.015 g/cm$^3$, 0.014 g/cm$^3$, 0.013 g/cm$^3$, 0.012 g/cm$^3$, 0.011 g/cm$^3$, 0.01 g/cm$^3$, 0.009 g/cm$^3$, 0.008 g/cm$^3$, 0.007 g/cm$^3$, 0.006 g/cm$^3$, 0.005 g/cm$^3$, 0.004 g/cm$^3$, 0.003 g/cm$^3$, 0.002 g/cm$^3$, or 0.001 g/cm$^3$. The alloys may have a reduction in liquid density, at 20% solidification of the alloy, of about 0.025 g/cm$^3$, about 0.02 g/cm$^3$, about 0.015 g/cm$^3$, about 0.011 g/cm$^3$, about 0.01 g/cm$^3$, or about 0.005 g/cm$^3$.

The alloys may have a reduction in liquid density, at 40% solidification of the alloy, of 0 to 0.035 g/cm$^3$, 0 to 0.03 g/cm$^3$, 0 to 0.025 g/cm$^3$, 0 to 0.022 g/cm$^3$, 0 to 0.02 g/cm$^3$, 0 to 0.015 g/cm$^3$, 0 to 0.01 g/cm$^3$, or 0 to 0.005 g/cm$^3$. The alloys may have a reduction in liquid density, at 40% solidification of the alloy, of 0.035 g/cm$^3$, 0.034 g/cm$^3$, 0.033 g/cm$^3$, 0.032 g/cm$^3$, 0.031 g/cm$^3$, 0.03 g/cm$^3$, 0.029 g/cm$^3$, 0.028 g/cm$^3$, 0.027 g/cm$^3$, 0.026 g/cm$^3$, 0.025 g/cm$^3$, 0.024 g/cm$^3$, 0.023 g/cm$^3$, 0.022 g/cm$^3$, 0.021 g/cm$^3$, 0.02 g/cm$^3$, 0.019 g/cm$^3$, 0.018 g/cm$^3$, 0.017 g/cm$^3$, 0.016 g/cm$^3$, 0.015 g/cm$^3$, 0.014 g/cm$^3$, 0.013 g/cm$^3$, 0.012 g/cm$^3$, 0.011 g/cm$^3$, 0.01 g/cm$^3$, 0.009 g/cm$^3$, 0.008 g/cm$^3$, 0.007 g/cm$^3$, 0.006 g/cm$^3$, 0.005 g/cm$^3$, 0.004 g/cm$^3$, 0.003 g/cm$^3$, 0.002 g/cm$^3$, or 0.001 g/cm$^3$. The alloys may have a reduction in liquid density, at 40% solidification of the alloy, of about 0.035 g/cm$^3$, about 0.03 g/cm$^3$, about 0.025 g/cm$^3$, about 0.022 g/cm$^3$, about 0.02 g/cm$^3$, about 0.015 g/cm$^3$, about 0.011 g/cm$^3$, about 0.01 g/cm$^3$, or about 0.005 g/cm$^3$.

The alloys may be essentially free of topologically close-packed phases. In certain embodiments, the alloys do not comprise topologically close-packed phases.

The alloys may have a γ' phase fraction, after aging, of greater than 50%, greater than 51%, greater than 52%, greater than 53%, greater than 54%, greater than 55%, greater than 56%, greater than 57%, greater than 58%, greater than 59%, greater than 60%, greater than 61%, greater than 62%, greater than 63%, greater than 64%, greater than 65%, greater than 66%, greater than 67%, greater than 68%, greater than 69%, or greater than 70%. The alloys may have a γ' phase fraction, after aging, of 50%, 51%, 52%, 53%, 54%, 55%, 56%, 57%, 58%, 59%, 60%, 61%, 62%, 63%, 64%, 65%, 65%, 66%, 67%, 68%, 69%, 70%, 71%, 72%, 73%, 74%, 75%, 75%, 76%, 77%, 78%, 79%, or 80%. The alloys may have a γ' phase fraction, after aging, of about 50%, about 55%, about 59%, about 60%, about 65%, about 67%, about 69%, about 70%, or about 75%.

The alloys may have a γ' phase fraction, after aging the alloy at 1150° C. for 30 hours, of greater than 35%, greater than 36%, greater than 37%, greater than 38%, greater than 39%, greater than 40%, greater than 41%, greater than 42%, greater than 43%, greater than 44%, greater than 45%, greater than 46%, greater than 47%, greater than 48%, greater than 49%, greater than 50%, greater than 51%, greater than 52%, greater than 53%, greater than 54%, or greater than 55%. The alloys may have a γ' phase fraction, after aging the alloy at 1150° C. for 30 hours, of 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, or 70%. The alloys may have a γ' phase fraction, after aging the alloy at 1150° C. for 30 hours, of about 35%, about 40%, about 45%, about 47%, about 50%, about 55%, or about 60%.

The alloys may have a γ/γ' lattice misfit, at 1000° C., of 0 to about −0.35%, 0 to about −0.3%, 0 to about −0.27%, 0 to about −0.25%, 0 to about −0.2%, 0 to about −0.15%, 0 to about −0.1%, or 0 to about −0.5%. The alloys may have a γ/γ' lattice misfit, at 1000° C., of −0.35%, −0.34%, −0.33%, −0.32%, −0.31%, −0.3%, −0.29%, −0.28%, −0.27%, −0.26%, −0.25%, −0.24%, −0.23%, −0.22%, −0.21%, −0.2%, −0.19%, −0.18%, −0.17%, −0.16%, −0.15%, −0.14%, −0.13%, −0.12%, −0.11%, −0.1%, −0.09%, −0.08%, −0.07%, −0.06%, −0.05%, −0.04%, −0.03%, −0.02%, or −0.01%. The alloys may have a γ/γ' lattice misfit, at 1000° C., of about −0.35%, about −0.3%, about −0.27%, about −0.25%, about −0.2%, about −0.15%, about −0.11%, about −0.1%, or about −0.05%.

The alloys may have a γ/γ' lattice misfit sufficiently small that the γ' precipitates have a cuboidal morphology. The γ' precipitates of the alloys may have a cuboidal morphology. In certain embodiments, the γ' precipitates of the alloys have a cuboidal morphology.

The alloys may have an interfacial energy normalized coarsening rate, at 1000° C., of $9.0\times10^{-20}$ or less, $8.5\times10^{-20}$ or less, $8.0\times10^{-20}$ or less, $7.5\times10^{-20}$ or less, $7.0\times10^{-20}$ or less, $6.8\times10^{-20}$ or less, $6.7\times10^{-20}$ or less, $6.6\times10^{-20}$ or less, $6.59\times10^{-20}$ or less, $6.5\times10^{-20}$ or less, $6.0\times10^{-20}$ or less, $5.5\times10^{-20}$ or less, or $5.0\times10^{-20}$ or less. The alloys may have an interfacial energy normalized coarsening rate, at 1000° C., of $9.0\times10^{-20}$, $8.9\times10^{-20}$, $8.8\times10^{-20}$, $8.7\times10^{-20}$, $8.6\times10^{-20}$, $8.5\times10^{-20}$, $8.4\times10^{-20}$, $8.3\times10^{-20}$, $8.2\times10^{-20}$, $8.1\times10^{-20}$, $8.0\times10^{-20}$, $7.9\times10^{-20}$, $7.8\times10^{-20}$, $7.7\times10^{-20}$, $7.6\times10^{-20}$, $7.5\times10^{-20}$, $7.4\times10^{-20}$, $7.3\times10^{-20}$, $7.2\times10^{-20}$, $7.1\times10^{-20}$, $7.0\times10^{-20}$, $6.9\times10^{-20}$, $6.8\times10^{-20}$, $6.7\times10^{-20}$, $6.6\times10^{-20}$, $6.59\times10^{-20}$, $6.5\times10^{-20}$, $6.4\times10^{-20}$, $6.3\times10^{-20}$, $6.2\times10^{-20}$, $6.1\times10^{-20}$, $6.0\times10^{-20}$, $5.9\times10^{-20}$, $5.8\times10^{-20}$, $5.7\times10^{-20}$, $5.6\times10^{-20}$, $5.5\times10^{-20}$, $5.4\times10^{-20}$, $5.3\times10^{-20}$, $5.2\times10^{-20}$, $5.1\times10^{-20}$, or $5.0\times10^{-20}$. The alloys may have an interfacial energy normalized coarsening rate, at 1000° C., of about $9.0\times10^{-20}$, about $8.5\times10^{-20}$, about $8.0\times10^{-20}$, about $7.5\times10^{-20}$, about $7.0\times10^{-20}$, about $6.8\times10^{-20}$, about $6.7\times10^{-20}$, about $6.6\times10^{-20}$, about $6.59\times10^{-20}$ about $6.5\times10^{-20}$, about $6.0\times10^{-20}$, about $5.5\times10^{-20}$, or about $5.0\times10^{-20}$.

The alloys may have a hardness, after aging, of greater than 300 HV, greater than 310 HV, greater than 320 HV, greater than 330 HV, greater than 340 HV, greater than 350

HV, greater than 360 HV, greater than 370 HV, greater than 380 HV, greater than 390 HV, greater than 400 HV, greater than 410 HV, greater than 420 HV, greater than 430 HV, greater than 440 HV, greater than 450 HV, greater than 460 HV, greater than 470 HV, greater than 480 HV, greater than 490 HV, greater than 500 HV, or greater than 510 HV. The alloys may have a hardness, after aging, of 300 HV, 310 HV, 320 HV, 330 HV, 340 HV, 350 HV, 360 HV, 370 HV, 380 HV, 390 HV, 400 HV, 401 HV, 402 HV, 403 HV, 404 HV, 405 HV, 406 HV, 407 HV, 408 HV, 409 HV, 410 HV, 411 HV, 412 HV, 413 HV, 414 HV, 415 HV, 416 HV, 417 HV, 418 HV, 419 HV, 420 HV, 421 HV, 422 HV, 423 HV, 424 HV, 425 HV, 426 HV, 427 HV, 428 HV, 429 HV, 430 HV, 431 HV, 432 HV, 433 HV, 434 HV, 435 HV, 436 HV, 437 HV, 438 HV, 439 HV, 440 HV, 441 HV, 442 HV, 443 HV, 444 HV, 445 HV, 446 HV, 447 HV, 448 HV, 449 HV, 450 HV, 451 HV, 452 HV, 453 HV, 454 HV, 455 HV, 456 HV, 457 HV, 458 HV, 459 HV, 460 HV, 461 HV, 462 HV, 463 HV, 464 HV, 465 HV, 466 HV, 467 HV, 468 HV, 469 HV, 470 HV, 471 HV, 472 HV, 473 HV, 474 HV, 475 HV, 476 HV, 477 HV, 478 HV, 479 HV, 480 HV, 481 HV, 482 HV, 483 HV, 484 HV, 485 HV, 486 HV, 487 HV, 488 HV, 489 HV, 490 HV, 491 HV, 492 HV, 493 HV, 494 HV, 495 HV, 496 HV, 497 HV, 498 HV, 499 HV, 500 HV, 505 HV, 510 HV, 520 HV, 530 HV, 540 HV, 550 HV, 560 HV, 570 HV, 580 HV, 590 HV, or 600 HV. The alloys may have a hardness, after aging, of about 300 HV, about 310 HV, about 320 HV, about 330 HV, about 340 HV, about 350 HV, about 360 HV, about 370 HV, about 380 HV, about 390 HV, about 400 HV, about 410 HV, about 420 HV, about 430 HV, about 440 HV, about 450 HV, about 460 HV, about 470 HV, about 480 HV, about 490 HV, about 500 HV, or about 510 HV. The hardness may be measured according to ASTM E92, ASTM E18, and ASTM E140.

The alloys may have an ultimate tensile strength of 80 ksi to 200 ksi, 100 ksi to 200 ksi, 130 ksi to 200 ksi, 150 ksi to 200 ksi, 160 ksi to 200 ksi, or 170 ksi to 200 ksi, over a temperature range of 72-2000° F. The alloys may have an ultimate tensile strength of 80 ksi to 200 ksi, 100 ksi to 200 ksi, 130 ksi to 200 ksi, 150 ksi to 200 ksi, 160 ksi to 200 ksi, or 170 ksi to 200 ksi, over a temperature range of 72-1800° F. The alloys may have an ultimate tensile strength of 80 ksi to 200 ksi, 100 ksi to 200 ksi, 130 ksi to 200 ksi, 150 ksi to 200 ksi, 160 ksi to 200 ksi, or 170 ksi to 200 ksi, over a temperature of 72-1600° F. The alloys may have an ultimate tensile strength of 80 ksi to 200 ksi, 100 ksi to 200 ksi, 130 ksi to 200 ksi, 150 ksi to 200 ksi, 160 ksi to 200 ksi, or 170 ksi to 200 ksi, over a temperature of 72-1400° F. The alloys may have an ultimate tensile strength of 80 ksi to 200 ksi, 100 ksi to 200 ksi, 130 ksi to 200 ksi, 150 ksi to 200 ksi, 160 ksi to 200 ksi, or 170 ksi to 200 ksi, over a temperature of 1000-1400° F. The alloys may have an ultimate tensile strength of 80 ksi to 200 ksi, 100 ksi to 200 ksi, 130 ksi to 200 ksi, 150 ksi to 200 ksi, 160 ksi to 200 ksi, or 170 ksi to 200 ksi, at a temperature of 72° F., 1000° F., 1200° F., 1400° F., 1600° F., 1800° F., or 2000° F. The alloys may have an ultimate tensile strength of at least 80 ksi, at least 90 ksi, at least 100 ksi, at least 110 ksi, at least 120 ksi, at least 130 ksi, at least 140 ksi, at least 150 ksi, at least 160 ksi, at least 170 ksi, at least 180 ksi, or at least 190 ksi at a temperature of 72° F. The alloys may have an ultimate tensile strength of at least 80 ksi, at least 90 ksi, at least 100 ksi, at least 110 ksi, at least 120 ksi, at least 130 ksi, at least 140 ksi, at least 150 ksi, at least 160 ksi, at least 170 ksi, at least 180 ksi, or at least 190 ksi at a temperature of 1000° F. The alloys may have an ultimate tensile strength of at least 80 ksi, at least 90 ksi, at least 100 ksi, at least 110 ksi, at least 120 ksi, at least 130 ksi, at least 140 ksi, at least 150 ksi, at least 160 ksi, at least 170 ksi, at least 180 ksi, or at least 190 ksi at a temperature of 1200° F. The alloys may have an ultimate tensile strength of at least 80 ksi, at least 90 ksi, at least 100 ksi, at least 110 ksi, at least 120 ksi, at least 130 ksi, at least 140 ksi, at least 150 ksi, at least 160 ksi, at least 170 ksi, at least 180 ksi, or at least 190 ksi at a temperature of 1400° F. The alloys may have an ultimate tensile strength of at least 80 ksi, at least 90 ksi, at least 100 ksi, at least 110 ksi, at least 120 ksi, at least 130 ksi, at least 140 ksi, at least 150 ksi, at least 160 ksi, at least 170 ksi, at least 180 ksi, or at least 190 ksi at a temperature of 1600° F. The alloys may have an ultimate tensile strength of at least 80 ksi, at least 90 ksi, at least 100 ksi, at least 110 ksi, at least 120 ksi, at least 130 ksi, at least 140 ksi, at least 150 ksi, at least 160 ksi, at least 170 ksi, at least 180 ksi, or at least 190 ksi at a temperature of 1800° F. The alloys may have an ultimate tensile strength of at least 80 ksi, at least 90 ksi, at least 100 ksi, at least 110 ksi, at least 120 ksi, at least 130 ksi, at least 140 ksi, at least 150 ksi, at least 160 ksi, at least 170 ksi, at least 180 ksi, or at least 190 ksi at a temperature of 2000° F. The ultimate tensile strength may be measured according to ASTM E8 and ASTM E21.

The alloys may have a 0.2% offset yield strength of 50 ksi to 170 ksi, 100 ksi to 170 ksi, 130 ksi to 170 ksi, 140 ksi to 170 ksi, 150 ksi to 170 ksi, or 150 ksi to 160 ksi, over a temperature range of 72-2000° F. The alloys may have a 0.2% offset yield strength, of 50 ksi to 170 ksi, 100 ksi to 170 ksi, 130 ksi to 170 ksi, 140 ksi to 170 ksi, 150 ksi to 170 ksi, or 150 ksi to 160 ksi, over a temperature range of 72-1800° F. The alloys may have a 0.2% offset yield strength, of 50 ksi to 170 ksi, 100 ksi to 170 ksi, 130 ksi to 170 ksi, 140 ksi to 170 ksi, 150 ksi to 170 ksi, or 150 ksi to 160 ksi, over a temperature range of 72-1600° F. The alloys may have a 0.2% offset yield strength, of 50 ksi to 170 ksi, 100 ksi to 170 ksi, 130 ksi to 170 ksi, 140 ksi to 170 ksi, 150 ksi to 170 ksi, or 150 ksi to 160 ksi, over a temperature range of 72-1400° F. The alloys may have a 0.2% offset yield strength, of 50 ksi to 170 ksi, 100 ksi to 170 ksi, 130 ksi to 170 ksi, 140 ksi to 170 ksi, 150 ksi to 170 ksi, or 150 ksi to 160 ksi, over a temperature range of 1000-1400° F. The alloys may have a 0.2% offset yield strength of 50 ksi to 170 ksi, 100 ksi to 170 ksi, 130 ksi to 170 ksi, 140 ksi to 170 ksi, 150 ksi to 170 ksi, or 150 ksi to 160 ksi, at a temperature of 72° F., 1000° F., 1200° F., 1400° F., 1600° F., 1800° F., or 2000° F. The alloys may have a 0.2% offset yield strength of at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at least 150 ksi, or at least 160 ksi at a temperature of 72° F. The alloys may have a 0.2% offset yield strength of at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at least 150 ksi, or at least 160 ksi at a temperature of 1000° F. The alloys may have a 0.2% offset yield strength of at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at least 150 ksi, or at least 160 ksi at a temperature of 1200° F. The alloys may have a 0.2% offset yield strength of at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at least 150 ksi, or at least 160 ksi at a temperature of 1400° F. The alloys may have a 0.2% offset yield strength of at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at least 150 ksi, or at least 160 ksi at a temperature of 1600° F. The alloys may have a 0.2% offset yield strength of at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at least 150 ksi, or at least 160 ksi at a temperature of 1800° F. The alloys may have a 0.2% offset yield strength of at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at least 150 ksi, or at least 160 ksi at a temperature of 2000° F. The 0.2% offset yield strength may be measured according to ASTM E8 and ASTM E21.

The alloys may have a percent elongation of 1% to 50%, 5% to 40%, 10% to 35%, or 20% to 30%, over a temperature range of 72-2000° F. The alloys may have a percent elongation of 1% to 50%, 5% to 40%, 10% to 35%, or 20% to 30%, over a temperature range of 1000-2000° F. The alloys may have a percent elongation of 1% to 50%, 5% to 40%, 10% to 35%, or 20% to 30%, over a temperature range of 1200-2000° F. The alloys may have a percent elongation of 1% to 50%, 5% to 40%, 10% to 35%, or 20% to 30%, over a temperature range of 1400-2000° F. The alloys may have a percent elongation of 1% to 50%, 5% to 40%, 10% to 35%, or 20% to 30%, over a temperature range of 1600-2000° F. The alloys may have a percent elongation of 1% to 50%, 5% to 40%, 10% to 35%, or 20% to 30%, at a temperature of 72° F., 1000° F., 1200° F., 1400° F., 1600° F., 1800° F., or 2000° F. The elongation may be measured according to ASTM E8 and ASTM E21.

The alloys may have a tensile reduction in area of 1% to 60%, 1% to 35%, 1% to 25%, 1% to 15%, 3% to 15%, or 7% to 15%, over a temperature range of 72-2000° F. The alloys may have a tensile reduction in area, of 1% to 60%, 1% to 35%, 1% to 25%, 1% to 15%, 3% to 15%, or 7% to 15%, over a temperature range of 72-1800° F. The alloys may have a tensile reduction in area, of 1% to 60%, 1% to 35%, 1% to 25%, 1% to 15%, 3% to 15%, or 7% to 15%, over a temperature range of 72-1600° F. The alloys may have a tensile reduction in area, of 1% to 60%, 1% to 35%, 1% to 25%, 1% to 15%, 3% to 15%, or 7% to 15%, over a temperature range of 72-1400° F. The alloys may have a tensile reduction in area, of 1% to 60%, 1% to 35%, 1% to 25%, 1% to 15%, 3% to 15%, or 7% to 15%, over a temperature range of 1000-1400° F. The alloys may have a tensile reduction in area of 1% to 60%, 1% to 35%, 1% to 25%, 1% to 15%, 3% to 15%, or 7% to 15%, at a temperature of 72° F., 1000° F., 1200° F., 1400° F., 1600° F., 1800° F., or 2000° F. The tensile reduction in area may be measured according to ASTM E8 and ASTM E21.

The alloys may have a modulus of elasticity of 10 Msi to 20 Msi, 11 Msi to 20 Msi, 12 Msi to 20 Msi, 12 Msi to 18 Msi, 14 Msi to 12 Msi, or 14 Msi to 18 Msi, over a temperature range of 72-2000° F. The alloys may have a modulus of elasticity of 10 Msi to 20 Msi, 11 Msi to 20 Msi, 12 Msi to 20 Msi, 12 Msi to 18 Msi, 14 Msi to 12 Msi, or 14 Msi to 18 Msi, over a temperature range of 72-1800° F. The alloys may have a modulus of elasticity of 10 Msi to 20 Msi, 11 Msi to 20 Msi, 12 Msi to 20 Msi, 12 Msi to 18 Msi, 14 Msi to 12 Msi, or 14 Msi to 18 Msi, over a temperature range of 72-1600° F. The alloys may have a modulus of elasticity of 10 Msi to 20 Msi, 11 Msi to 20 Msi, 12 Msi to 20 Msi, 12 Msi to 18 Msi, 14 Msi to 12 Msi, or 14 Msi to 18 Msi, over a temperature range of 72-1400° F. The alloys may have a modulus of elasticity of 10 Msi to 20 Msi, 11 Msi to 20 Msi, 12 Msi to 20 Msi, 12 Msi to 18 Msi, 14 Msi to 12 Msi, or 14 Msi to 18 Msi, over a temperature range of 72-1000° F. The alloys may have a modulus of elasticity of 10 Msi to 20 Msi, 11 Msi to 20 Msi, 12 Msi to 20 Msi, 12 Msi to 18 Msi, 14 Msi to 12 Msi, or 14 Msi to 18 Msi, at a temperature of 72° F., 1000° F., 1200° F., 1400° F., 1600° F., 1800° F., or 2000° F. The modulus of elasticity may be measured according to ASTM E8 and ASTM E21.

The alloys may have a stress rupture life of 50 hours to 400 hours, 70 hours to 350 hours, 80 hours to 350 hours, 100 hours to 350 hours, 110 hours to 350 hours, 140 hours to 350 hours, 200 hours to 350 hours, or 300 to 350 hours at 206.8 MPa and 1800° F. The alloys may have a stress rupture life of at least 100 hours, at least 150 hours, at least 200 hours, at least 250 hours, at least 300 hours, at least 320 hours, or at least 340 hours at 206.8 MPa and 1800° F. The alloys may have a stress rupture life of 50 hours to 400 hours, 70 hours to 350 hours, 80 hours to 350 hours, 100 hours to 350 hours, 110 hours to 350 hours, 140 hours to 350 hours, or 200 hours to 350 hours at 172.4 MPa and 1900° F. The alloys may have a stress rupture life of at least 100 hours, at least 150 hours, at least 200 hours, at least 210 hours or at least 220 hours at 172.4 MPa and 1900° F. The stress rupture life may be measured according to ASTM E139.

In the stress rupture test, the alloys may have a percent elongation of 15% to 50%, 20% to 50%, 20% to 45%, 25% to 45%, 30% to 45%, or 40% to 45%. The percent elongation of the rupture stress may be measured according to ASTM E139.

III. Methods of Producing Alloys

The alloys may be produced as a single crystal casting. After the melt is molded into a casting, the casting may be homogenized. The homogenization may include treatment for 1 hour to 4 hours at 1250° C. to 1290° C.; 1 hour to 4 hours at 1280° C. to 1300° C.; 1 hour to 4 hours at 1290° C. to 1305° C.; and 1 hour to 4 hours at 1300° C. to 1320° C.; with a heating rate of 0.1° C./second to 10° C./second between each step; and cooling to 0° C. to 100° C. in air or another atmosphere (e.g., argon). For example, the alloy can be homogenized by treatment for 2 hours at 1282° C., 2 hours at 1292° C., 6 hours at 1300° C., and 4 hours at 1305° C., with a heating rate of 0.5° C./second between each step; and cooling to room temperature in air. The homogenized alloy casting may be further tempered. The tempering may include a two-step treatment for 2 hours to 10 hours at 1000° C. to 1180° C. followed by 4 hours to 30 hours at 700° C. to 950° C. For example, the homogenized alloy casting may be further tempered by a two-step treatment for 4 hours at 1121° C. followed by 20 hours at 871° C.

IV. Articles of Manufacture

Also disclosed are manufactured articles including the disclosed alloys. Exemplary manufactured articles include, but are not limited to, blades of industrial gas turbines. The blades may have a length of 22 inches. The blades may have a length of 24 inches. The blades may have a length of 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, 37 inches, 38 inches, 39 inches, 40 inches, 41 inches, or 42 inches.

Exemplary manufactured articles include, but are not limited to, blades used in aerospace applications. The blades may have a length of 22 inches. The blades may have a length of 24 inches. The blades may have a length of 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, 37 inches, 38 inches, 39 inches, 40 inches, 41 inches, or 42 inches.

V. EXAMPLES

A nickel-based alloy was prepared and tested for physical properties. Table 4 shows the design and composition of the exemplified alloy (Alloy A).

TABLE 4

| | | Composition weight percentages of raw alloy | | | | | | | | | |
|---|---|---|---|---|---|---|---|---|---|---|---|
| | | Metal | | | | | | | | | |
| | | Al | Co | Cr | Hf | Mo | Re | Ta | Ti | W | Ni |
| Alloy A | Design Target (%) | 5.9 | 9.1 | 7.1 | 0.1 | 0.9 | 1.0 | 9.4 | 0.1 | 8.0 | balance |
| | Measured (%) | 5.89 | 9.04 | 7.03 | 0.1 | 0.91 | 1.03 | 9.5 | 0.11 | 7.81 | balance |

Example 1: Alloy A

A melt was prepared with the nominal composition of 5.89 Al, 9.04 Co, 7.03 Cr, 0.1 Hf, 0.91 Mo, 1.03 Re, 9.5 Ta, 0.11 Ti, 7.81 W, and balance Ni, in wt %. The melt was molded into a casting. The casting was homogenized by treatment for 2 hours at 1282° C., 2 hours at 1292° C., 6 hours at 1300° C., followed by 4 hours at 1305° C., with a heating rate of 0.5° C./second between each step. The homogenized casting was allowed to cool to room temperature in air. The casting was further tempered by treatment for 4 hours at 1121° C., followed by 20 hours at 871° C.

A. Analysis and Physical Testing of Alloy A

Figure 2:
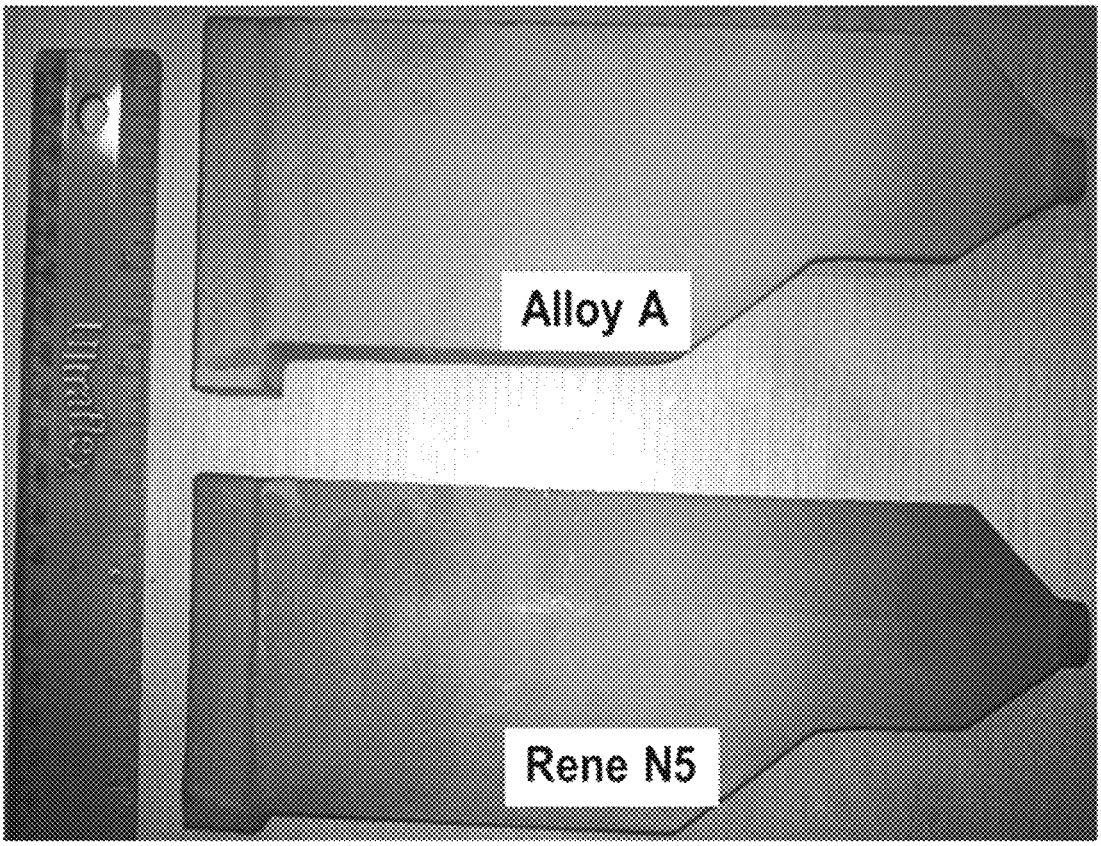
FIG. 2 is a picture of the castings of Alloy A (labeled as QTSX) and Rene N5.
Figure 3:
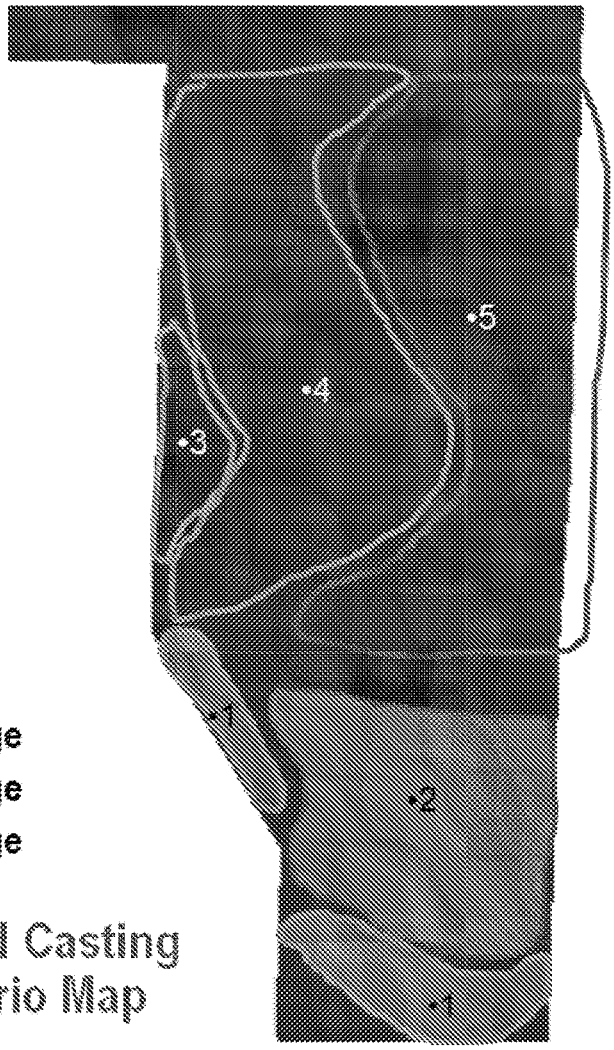
FIG. 3 is a map of the casting of Alloy A which shows the different regions analyzed for freckle and primary dendrite arm spacing.

The casting of Alloy A produced in Example 1 was analyzed for physical defects. The analysis of Alloy A was achieved in comparison with a casting of the known alloy, Rene N5, a previously disclosed nickel-based alloy. The casting of the Rene N5 alloy was accomplished by the same process used for the casting of Alloy A. FIG. 2 shows a side-by-side pictoral comparison of the two castings. Visible inspection of the two alloys revealed that Alloy A had no bigrains, and no sliver grains, whereas the Rene N5 alloy had one bigrain, and one sliver grain. Further analysis, shown in FIG. 3, shows the castings subdivided into 5 regions. Analyses of these regions revealed that neither Alloy A, nor the Rene N5 alloy have freckles. In addition, the primary dendrite arm spacing (PDAS) of each region of Alloy A was measured. These results are shown in Table 5.

TABLE 5

| Location | Average PDAS (micron) | Standard Deviation (micron) |
|---|---|---|
| 2 | 278.9 | 47 |
| 3 | 373.3 | 68 |
| 4 | 357.5 | 55 |
| 5 | 346 | 68 |

Figure 4:
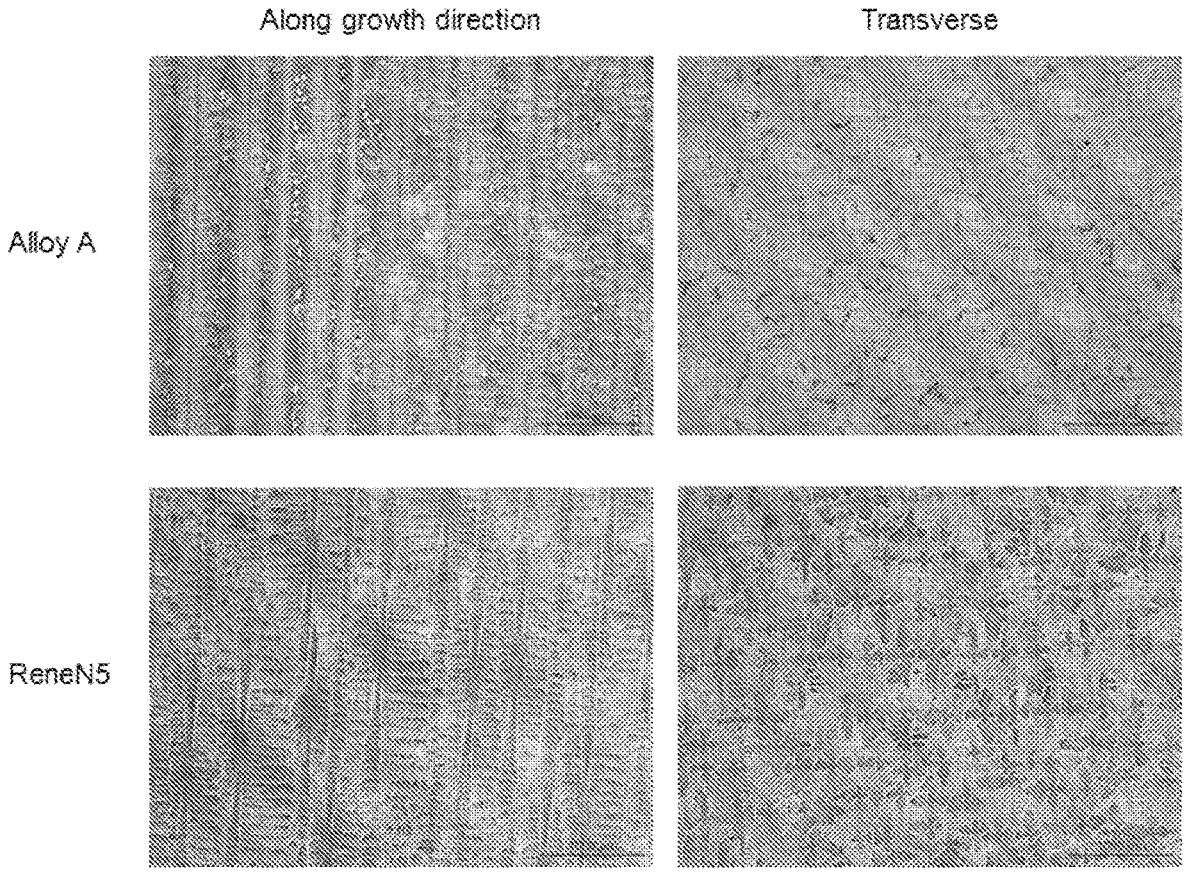
FIG. 4 is a series of micrographs showing the microstructures of the castings in the along growth direction and transverse axes of Alloy A and Rene N5.

FIG. 4 shows the microstructures of Alloy A and Rene N5 as casted. The set of micrographs on the left shows the microstructure of the respective alloys along the growth direction axis, whereas the micrographs on the right show the microstructure along the transverse axis.

Figure 5:
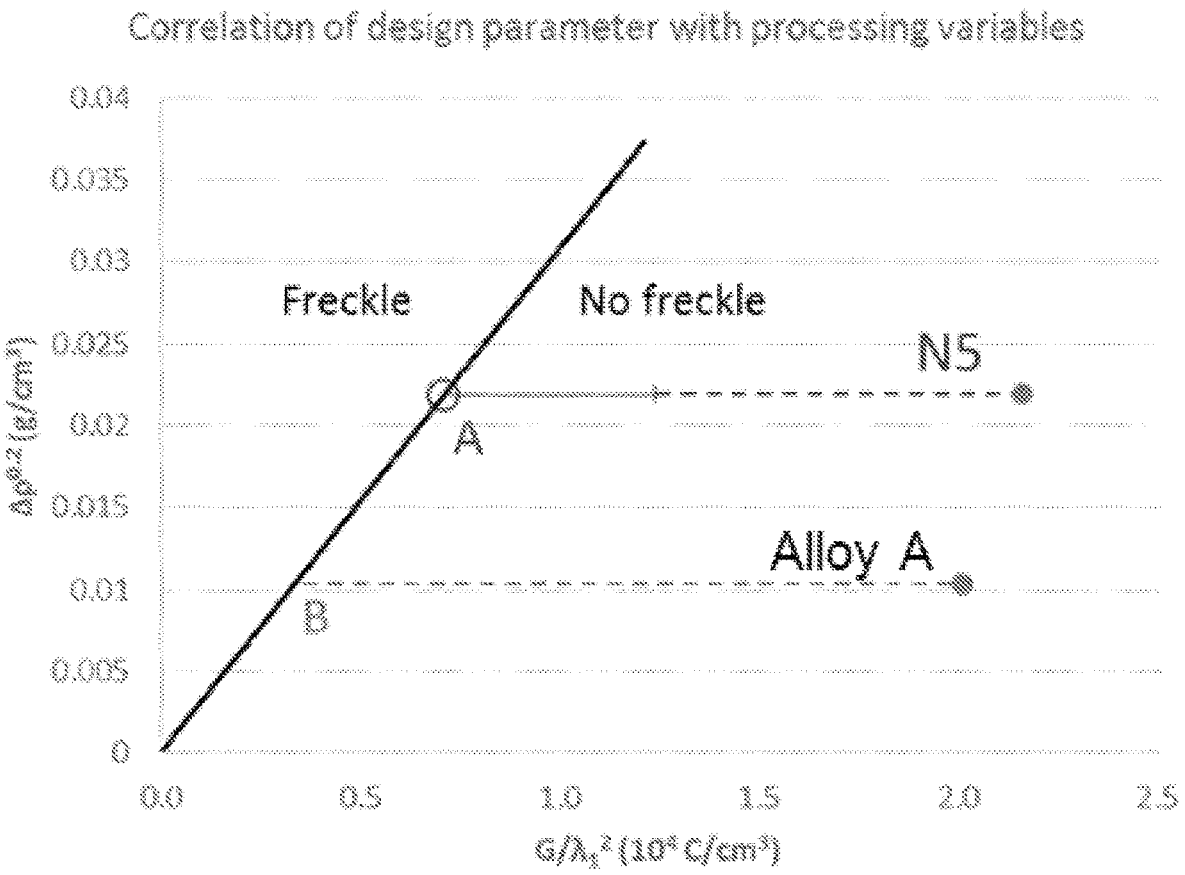
FIG. 5 is a graph relating the design parameters ($\Delta\rho^{0.2}$) to the processing variables ($G/\lambda_1^2$) of Alloy A and Rene N5.

Design parameters related to the change in liquid density at 20% solidification ($\Delta\rho^{0.2}$) were correlated with processing variables ($G/\lambda_1^2$) of the castings of Alloy A and Rene N5. FIG. 5 shows that Alloy A's lower value for $\Delta\rho^{0.2}$ allows it to have a larger processing window in which freckles will not form in the alloy casting process. In effect, Alloy A has greater freckle resistance than Rene N5, as it can have a lower $G/\lambda_1^2$ value than Rene N5 and still be free of freckles.

Figure 6:
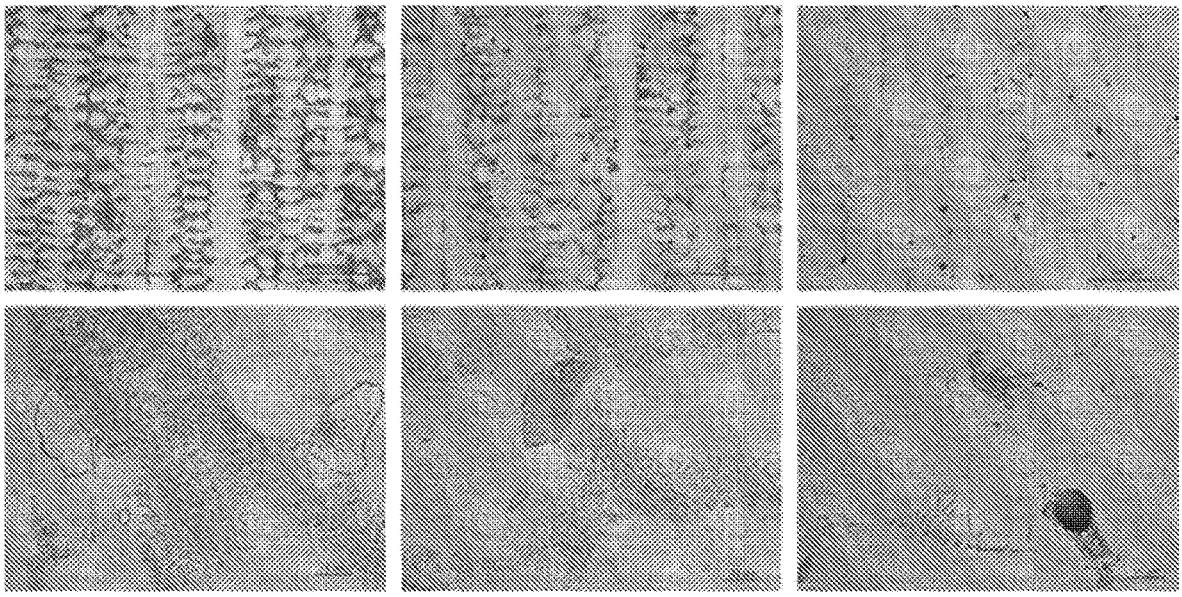
FIG. 6 is a series of micrographs showing the microstructure of Alloy A after isochronal heat treatment at a series of temperatures.

An isochronal homogenization study to determine the critical temperature for incipient melting of Alloy A was performed. The Alloy A casting was heated in various homogenized conditions, including: 1275° C. for 2 hours, 1282° C. for 2 hours, and 1290° C. for 2 hours. FIG. 6 shows micrographs of the alloy casting after heat treatment at the specified temperatures.

Figure 7:
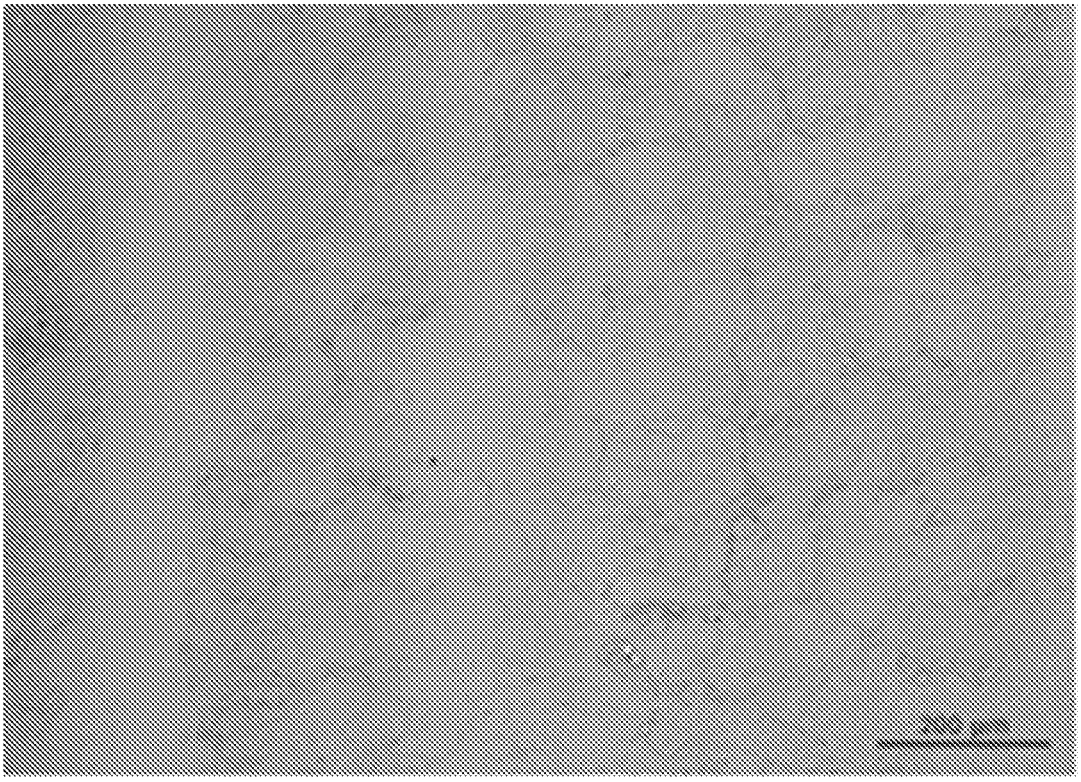
FIG. 7 is a micrograph showing the microstructure of Alloy A after homogenization.

A 4-step homogenization treatment of the alloy, as described above (2 hours at 1282° C., 2 hours at 1292° C., 6 hours at 1300° C., followed by 4 hours at 1305° C., with a heating rate of 0.5° C./second between each step), was identified that effectively avoided incipient melting, with the final step of the treatment occurring above the predicted γ' solvus. FIG. 7 shows micrographs detailing the microstructure of Alloy A after homogenization by this process.

Figure 8:
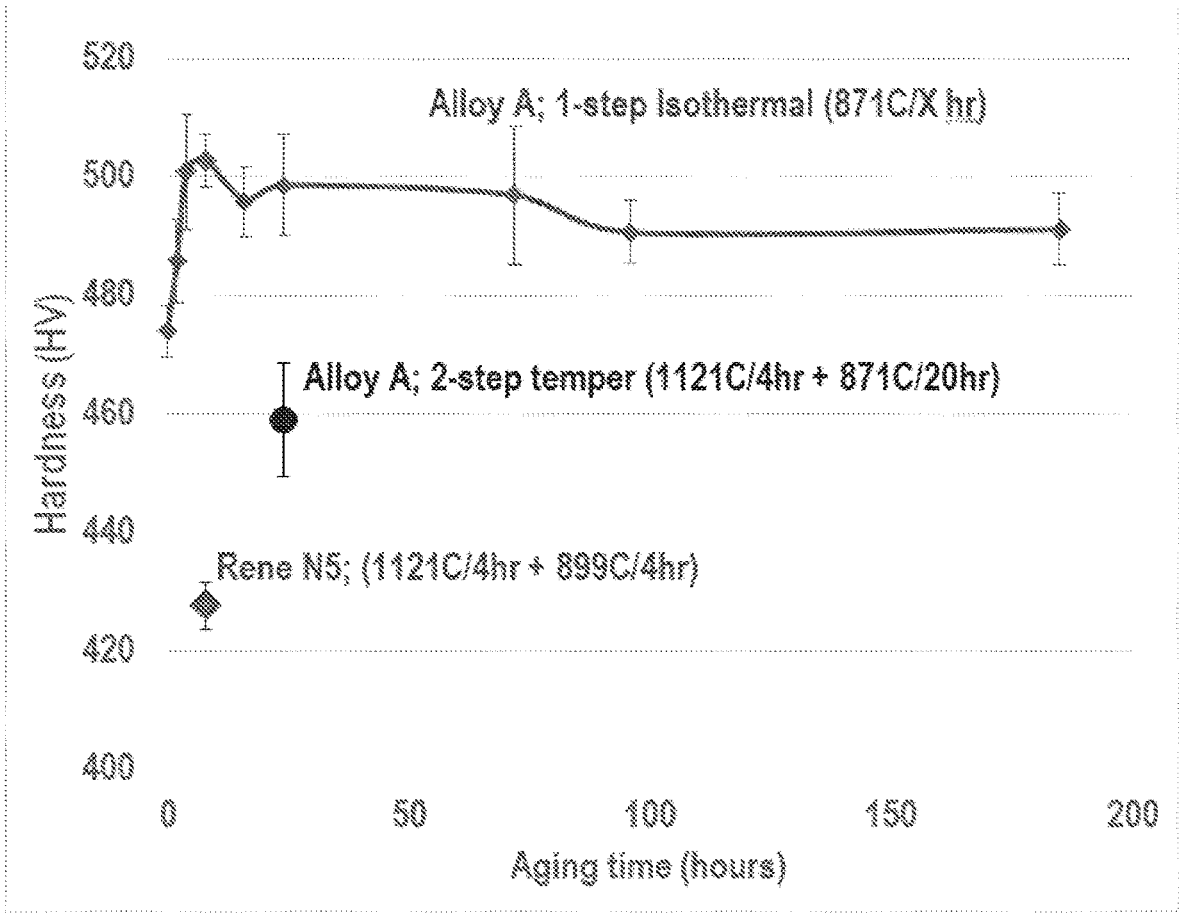
FIG. 8 is a graph showing the hardness (y-axis) versus aging time (x-axis) for different tempering conditions for Alloy A and Rene N5.

The strengths of Alloy A and Rene N5 were also evaluated in a series of temper studies. Alloy A was tempered by heating at 871° C. for 180 hours. Alloy A was also tempered using a two-step treatment (4 hours at 1121° C. followed by 20 hours at 871° C.). Rene N5 was tempered by also using a two-step treatment (4 hours at 1121° C. followed by 20 hours at 899° C.). FIG. 8 shows that Alloy A exhibits greater hardness than Rene N5.

Figure 9:
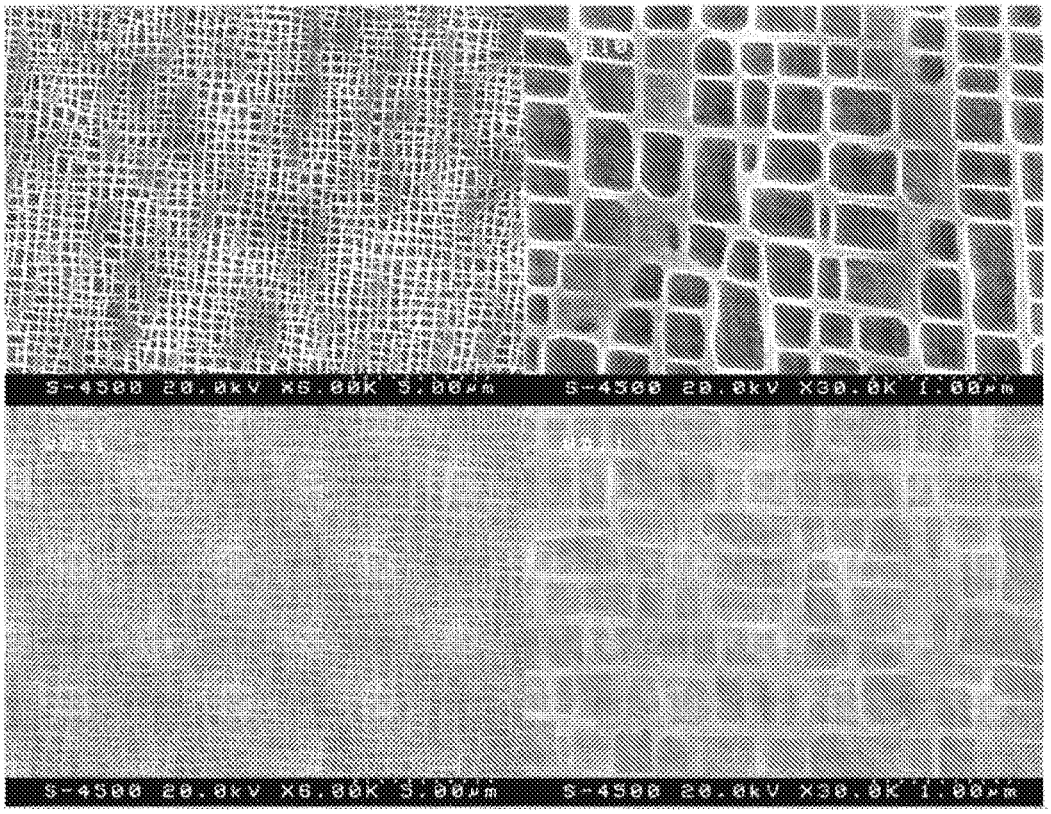
FIG. 9 is a series of micrographs showing the microstructures of Alloy A and Rene N5 after the tempering process.

The microstructure of Alloy A, after employment of the two-step temper process described above, revealed γ' precipitates that possess a cuboidal morphology (FIG. 9). The microstructure clearly shows γ' precipitates and the γ phase matrix. This characterization and microstructure analysis confirmed the achievement of the design goal of γ' phase fraction and lattice misfit. There was no evidence of topologically close-packed phases during the heat treatments.

Figure 10:
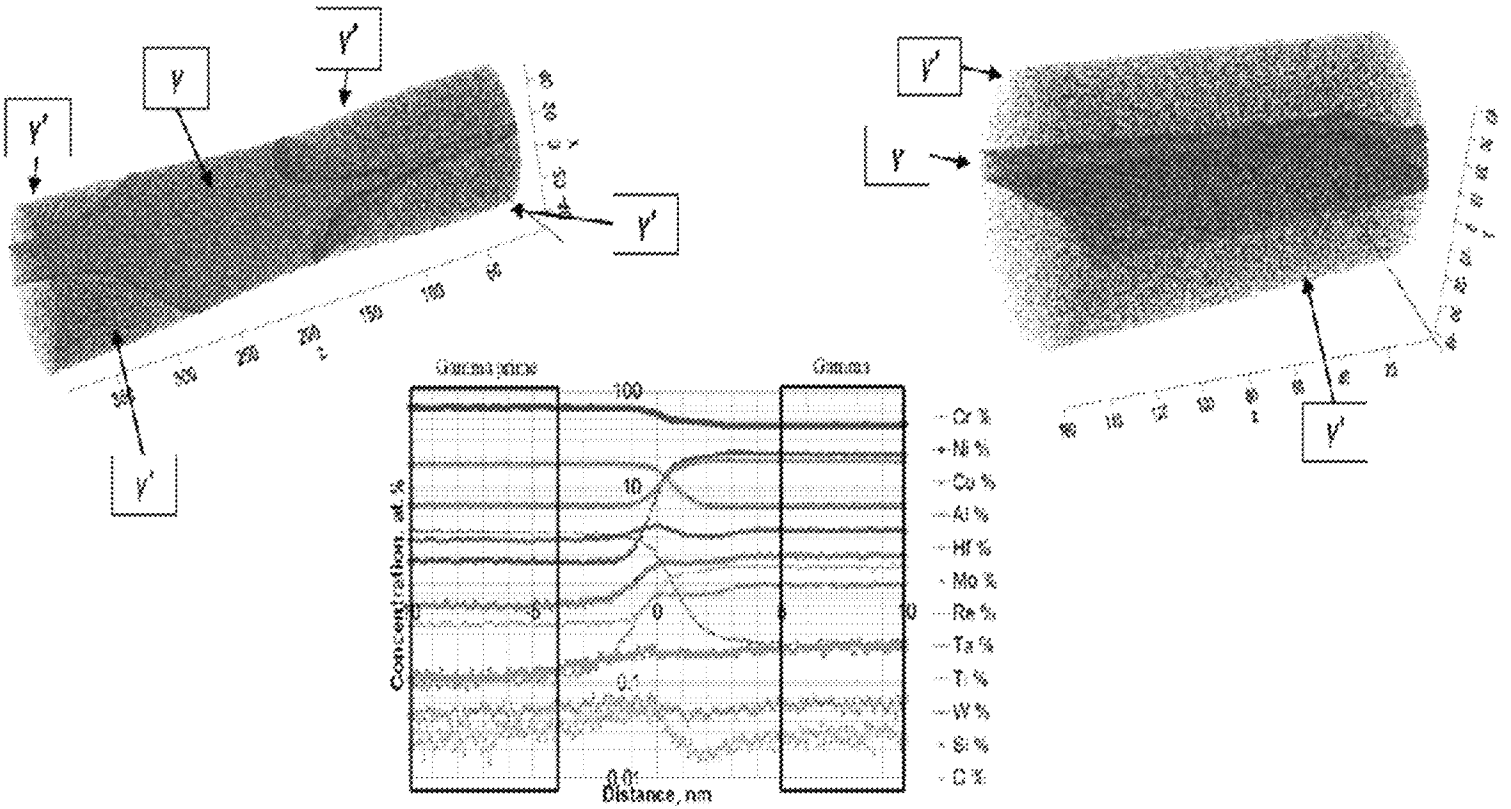
FIG. 10 illustrates the LEAP analysis of the nanostructure of Alloy A.

The nanostructure of Alloy A was determined using local electrode atom probe (LEAP) analysis. As shown in FIG. 10, two regions of the alloy were probed. In both regions, the morphology of the narrow channels of γ matrix is confirmed and the measured composition percentages of the alloying elements in the γ' phase were in excellent agreement with the predicted compositions.

Figure 11:
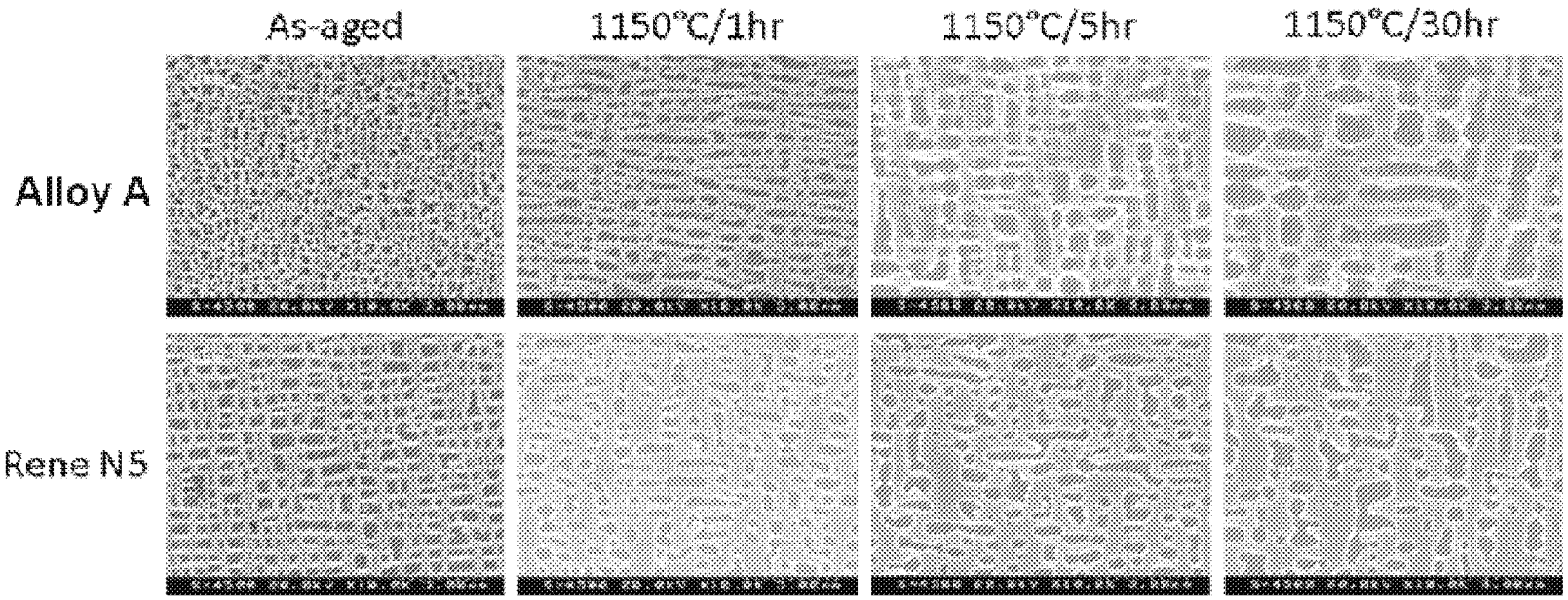
FIG. 11 is a series of micrographs showing the microstructures of Alloy A and Rene N5 at a series of time points during a long-term aging experiment at 1150° C.

Long-term aging studies of Alloy A and Rene N5 were also performed. Both alloys were subjected to heat treatment at 1150° C. for 30 hours. The γ' particle area and size were monitored, in addition to the γ' phase fraction. Table 6 shows the results of these studies. The data shows that Alloy A has a higher γ' phase fraction than Rene N5 as aged and after 1 and 30 hours at 1150° C. FIG. 11 illustrates these results, as it shows the evolution of the microstructures of the alloys over the course of the heat treatment.

TABLE 6

| | Alloy A | | | Rene N5 | | |
|---|---|---|---|---|---|---|
| Time at 1150° C. (hr) | Avg γ' particle area ($\mu m^2$) | Avg γ' particle size (μm) | γ' area fraction (%) | Avg γ' particle area ($\mu m^2$) | Avg γ' particle size (μm) | γ' area fraction (%) |
| 0 (as-aged) | 0.09 | 0.3 | 69 | 0.13 | 0.36 | 67.2 |
| 1 | 0.17 | 0.41 | 48.5 | 0.19 | 0.44 | 40 |
| 30 | 0.32 | 0.57 | 46.7 | 0.28 | 0.53 | 40 |

Figure 12:
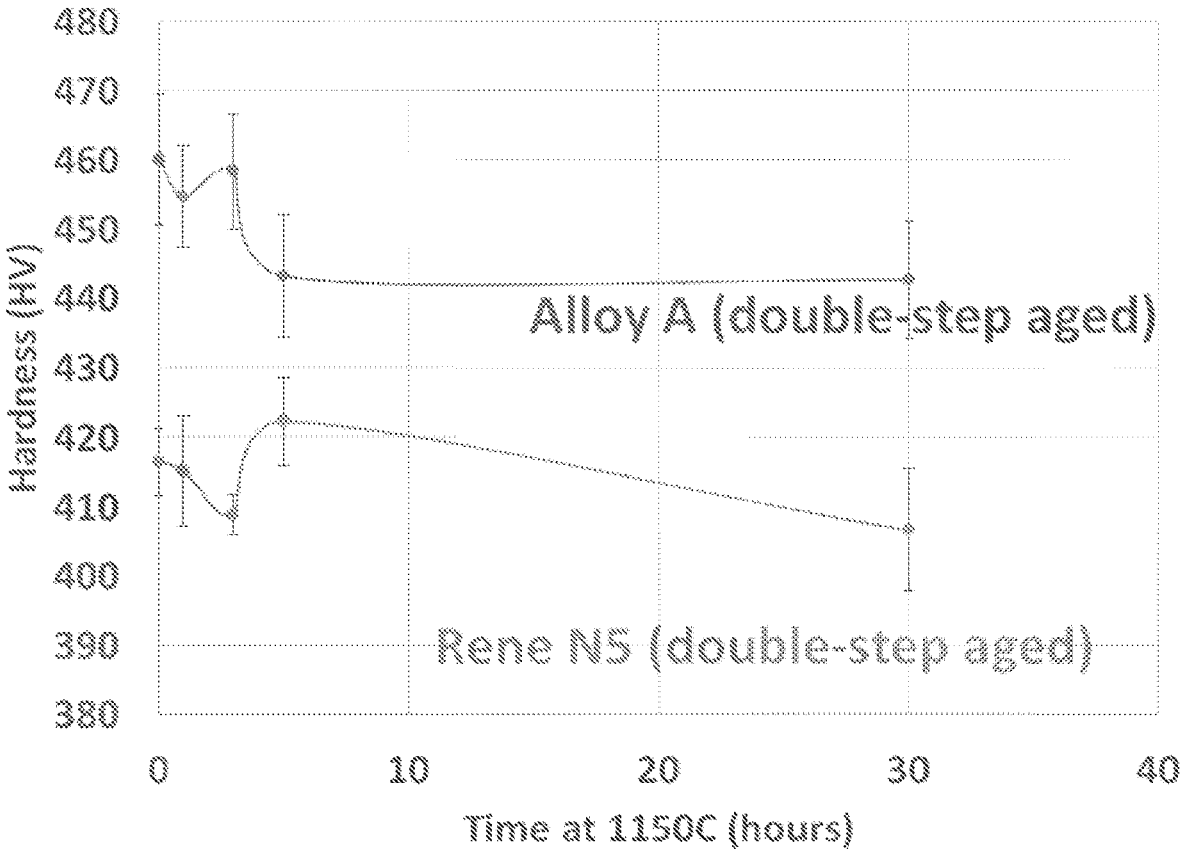
FIG. 12 is a graph showing the relationship between hardness and aging of Alloy A and Rene N5 at 1150° C.

The hardness of the alloys was also monitored over the course of this heat treatment. As FIG. 12 shows, Alloy A demonstrated greater hardness (strength) than Rene N5 at all the time points over the course of the study.

Figure 13:
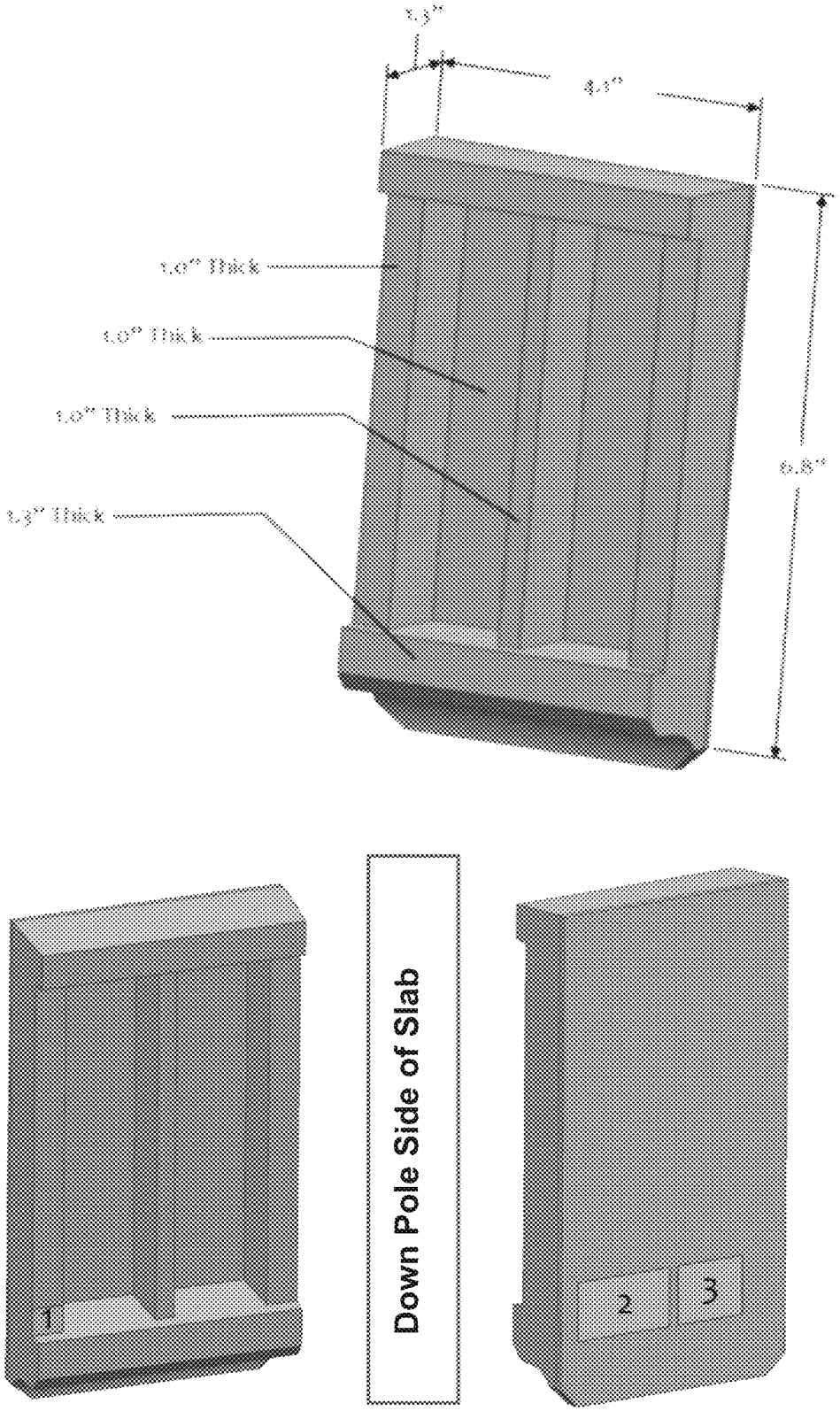
FIG. 13 is a series of drawings illustrating the geometrical design of a second set of single crystal nickel-based alloy castings. The locations on the castings labeled "1", "2" and "3" were identified as locations where freckles are most likely to form.
Figure 14:
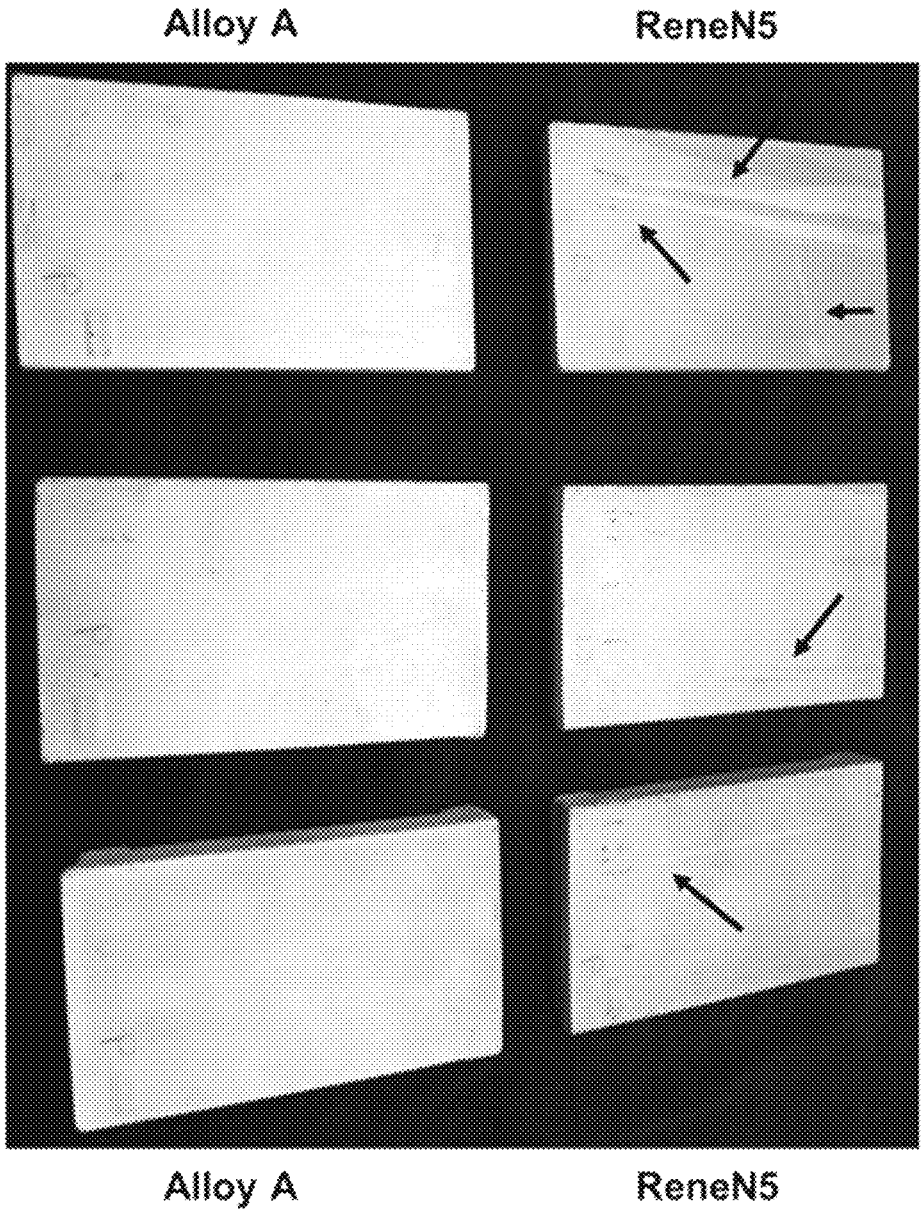
FIG. 14 is a picture of the top side of the second set of castings of Alloy A (labeled Questek Alloy) and Rene N5. The black arrows point to freckles.
Figure 15:
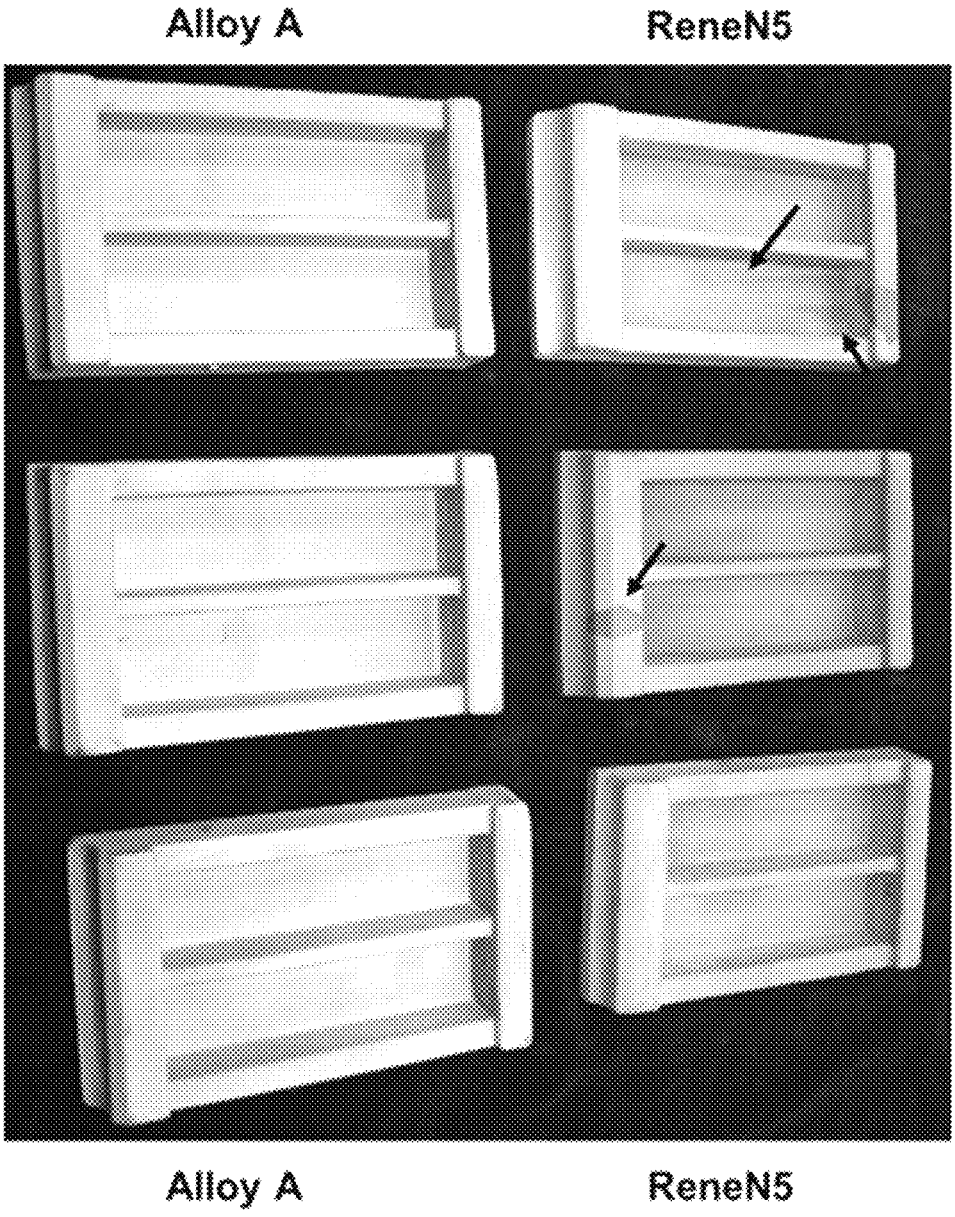
FIG. 15 is a picture of the reverse side of the second set of castings of Alloy A (labeled Questek Alloy) and Rene N5. The black arrows point to freckles.

A second set of castings of Alloy A and Rene N5 were achieved employing a different geometric design that promotes freckle formation during solidification. FIG. 13 illustrates the shape of the casting design. The second castings of Alloy A and Rene N5 were also analyzed for physical defects. As FIG. 14 and FIG. 15 demonstrate, the casting of Alloy A exhibited no freckles, whereas the castings of Rene N5 possessed numerous freckles.

Figure 16:
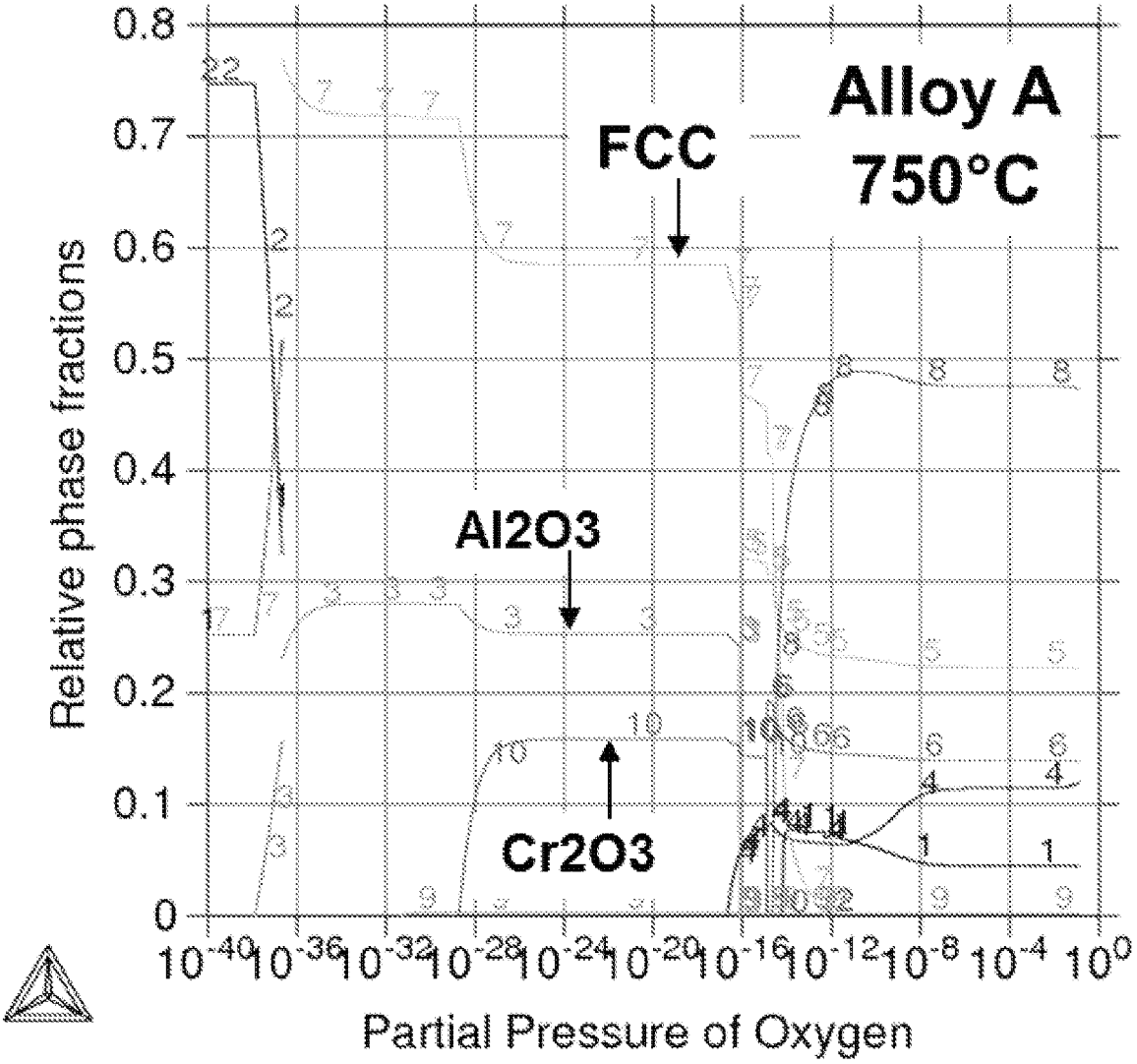
FIG. 16 is a phase diagram of stable phases in Alloy A as a function of oxygen partial pressure at an example temperature of 750° C., calculated using CALPHAD methods. These predictions are used to determine the stable oxide phases that form during oxidation.
Figure 17:
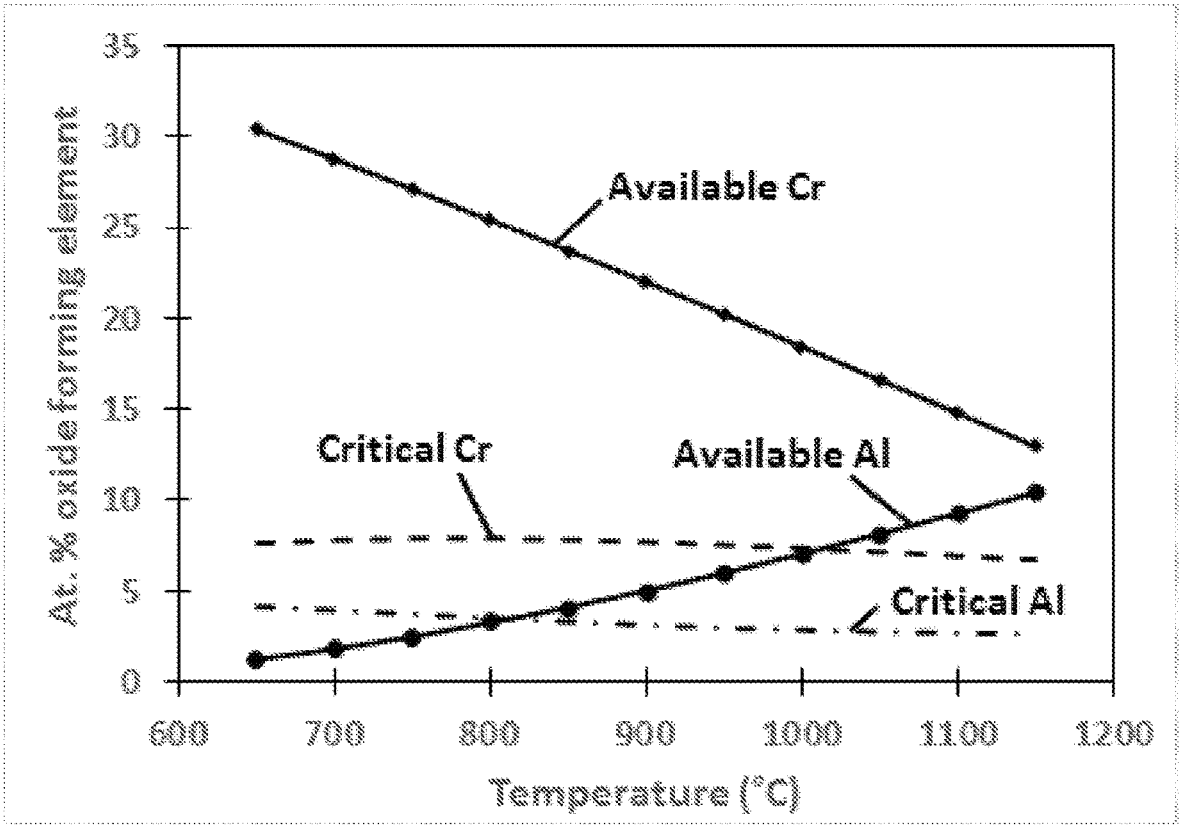
FIG. 17 is a graph depicting predictions of the critical Cr and Al contents necessary to achieve adherent, external oxide film formation at various temperatures (predicted from Wahl's modification of Wagner's oxidation model), compared to the Cr and Al contents in Alloy A available for oxidation within the temperature range.
Figure 18:
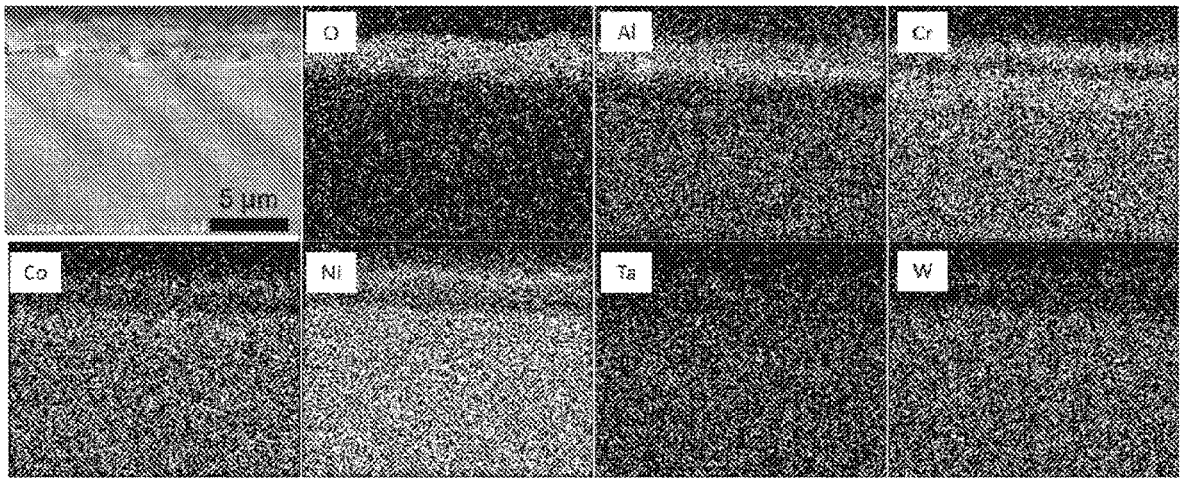
FIG. 18 is a scanning electron micrograph of the surface layer of Alloy A after oxidizing in air for 100 hours at 1000° C. Shown is a series of EDS composition maps of the qualitative segregation of certain elements at this oxidized surface layer, showing an adherent external $Al_2O_3$ and $Cr_2O_3$ protective oxide layer, validating model predictions of FIG. 16 and FIG. 17.

In addition, oxidation modeling of Alloy A was achieved by the use of Wahl's modification of Wagner's model to multicomponent systems. The oxygen concentration of the surface level of the alloy has been calculated using CALPHAD methods (See FIG. 16). Modeling results demonstrated that both $Al_2O_3$ and $Cr_2O_3$ are expected to form at high temperature, where available Al and Cr in the alloy surpass the critical amount that is required to form the continuous protective oxidation layer at the application temperature range (See FIG. 17). Furthermore, FIG. 18 shows the results of EDS mapping of Alloy A heat treated for 100 hours at 1000° C. confirming the formation of the continuous protective oxide layer on the surface. In all samples, continuous Al-rich oxide was observed thus providing sufficient oxidation resistance.

Figure 19:
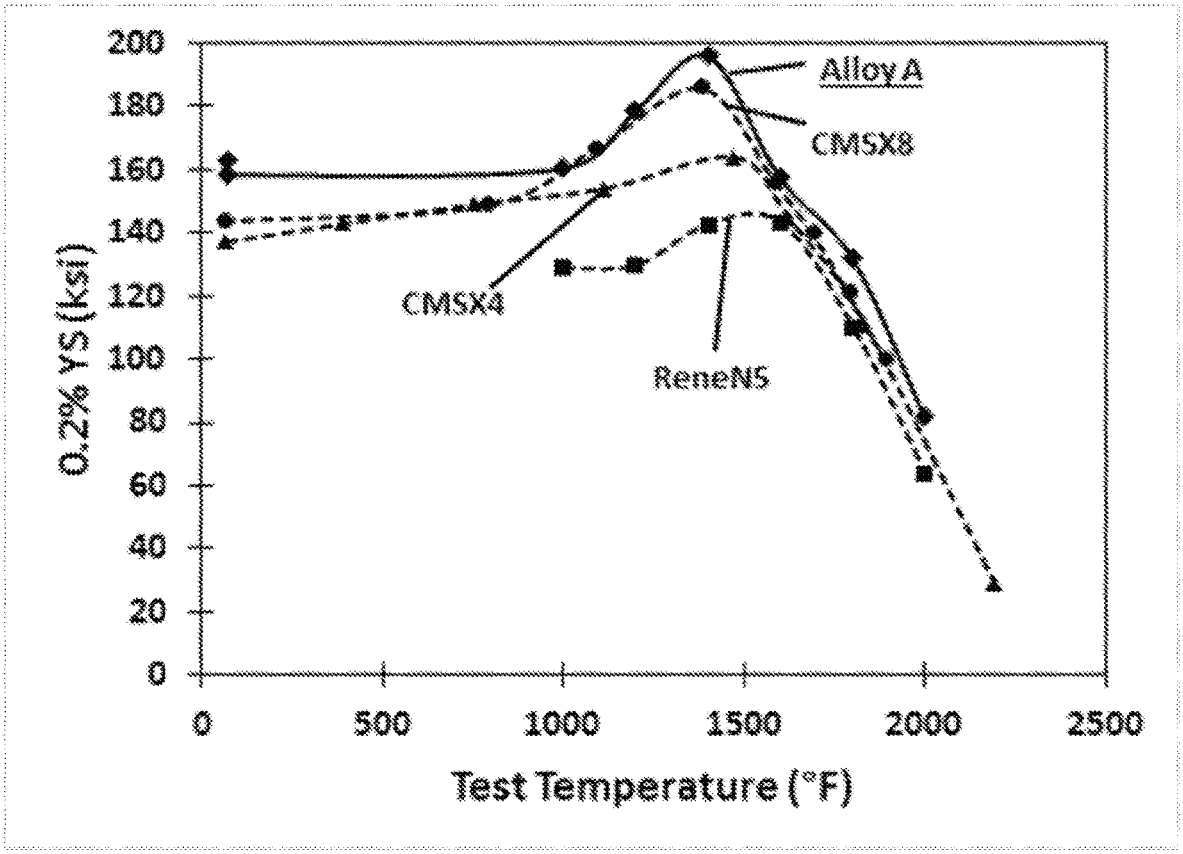
FIG. 19 is a graph depicting the 0.2% offset yield strength of Alloy A (labeled QTSX) in comparison to a series of commercial alloys at a series of different temperatures.
Figure 20:
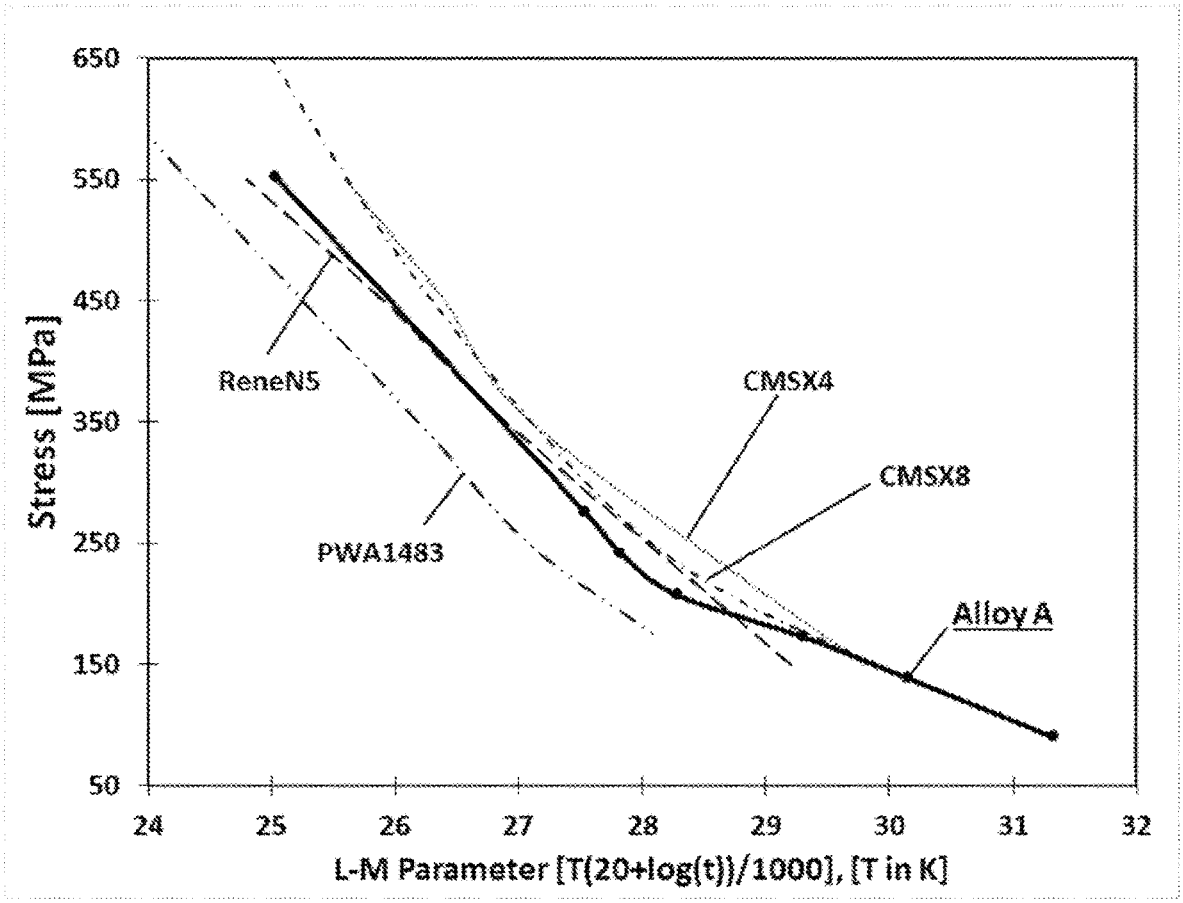
FIG. 20 is a graph depicting the rupture stress of Alloy A (labeled QTSX) in comparison to a series of commercial alloys.

Tensile testing of the first Alloy A casting and a variety of commercial alloys was accomplished according to ASTM E8 and ASTM E21. Table 7 shows the results for Alloy A at a temperature range of 72-2000° F., while FIG. 19 illustrates the results of Alloy A in comparison to the commercial alloys.

TABLE 7

| Temp (° F.) | 0.2% YS (ksi) | UTS (ksi) | % elongation | % reduction in area | Modulus (Msi) |
|---|---|---|---|---|---|
| 72 | 154.9 | 162.6 | 8 | 8.5 | 18.4 |
| 72 | 148.3 | 158.6 | 9.5 | 14 | 18.4 |
| 1000 | 152.1 | 160.3 | 4.5 | 4 | 15.9 |
| 1200 | — | 178.7 | 4.5 | 8.5 | — |
| 1400 | 160.3 | 195.8 | 9.5 | 13.5 | 14.1 |
| 1600 | 136.5 | 157.4 | 23.5 | 21.5 | 12.3 |
| 1800 | 107.2 | 131.9 | 23.5 | 31 | 11.1 |
| 2000 | 57.6 | 81.7 | 31 | 50.5 | 10.4 |

Stress rupture tests of the first Alloy A casting and a variety of commercial alloys were also performed according to ASTM E139. A series of temperatures and pressures were employed as testing conditions. Results of the test include the time to failure of each sample and the percent elongation of each sample at the time of failure. Table 8 shows the results for Alloy A at a temperature range of 1600-2100° F., while FIG. 19 illustrates the results of Alloy A in comparison to the commercial alloys.

TABLE 8

| Temp (° F.) | Test Stress (MPa) | Life (hr) | % elongation |
|---|---|---|---|
| 1600 | 551.6 | 76.7 | 20.6 |
| 1800 | 275.8 | 86.6 | 30 |
| 1800 | 241.3 | 147.4 | 43.8 |
| 1800 | 206.8 | 340.6 | 41.4 |
| 1900 | 172.4 | 224.6 | 43.8 |
| 2000 | 137.9 | 119 | 30.6 |
| 2100 | 89.6 | 107.7 | 24.8 |

Taken together, these results demonstrate that the elemental composition of Alloy A allows it to have excellent processability. Combined with the casting process, the homogenization and tempering steps lead to formation of a robust alloy that can be manufactured into articles useful for high temperature applications. The design implemented is reliant upon processing parameters such as liquid buoyancy and lattice misfit that promotes the robust production of a single crystal nickel-based superalloy that is free of defects and has favorable properties over existing nickel-based alloys.

It is understood that the disclosure may embody other specific forms without departing from the spirit or central characteristics thereof. The disclosure of aspects and embodiments, therefore, are to be considered in all respects as illustrative and not restrictive, and the claims are not to be limited to the details given herein. Accordingly, while specific embodiments have been illustrated and described, numerous modifications come to mind without significantly departing from the spirit of the invention and the scope of protection is only limited by the scope of the accompanying claims. Unless noted otherwise, all percentages listed herein are weight percentages.

For reasons of completeness, various aspects of the present disclosure are set out in the following numbered clauses:

Clause 1. An alloy comprising, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities.

Clause 2. The alloy of claim 1, wherein the alloy further comprises, by weight, 0% to about 0.5% lanthanum, 0% to about 0.5% yttrium, and 0 to about 0.5% boron.

Clause 3. An alloy comprising, by weight, about 5% to about 7% aluminum, 0% to about 0.2% carbon, about 8% to about 10% cobalt, about 6% to about 8% chromium, about 0.01% to about 0.2% hafnium, about 0.5% to about 2% molybdenum, 0% to about 1.5% rhenium, about 8.5% to about 10.5% tantalum, about 0.01% to about 0.2% titanium, and about 7% to about 9% tungsten, the balance essentially nickel and incidental elements and impurities.

Clause 4. The alloy of clause 1 or 2, wherein the alloy comprises, by weight, about 5.5% to about 6.5% aluminum, about 8.5% to about 9.5% cobalt, about 6.5% to about 7.5% chromium, about 0.05% to about 0.15% hafnium, about 0.6% to about 1.2% molybdenum, about 0.8% to about 1.2% rhenium, about 9% to about 10% tantalum, about 0.05% to about 0.15% titanium, and about 7.5% to about 8.5% tungsten, the balance essentially nickel and incidental elements and impurities.

Clause 5. The alloy of any of clauses 1-4, wherein the alloy is a single crystal.

Clause 6. The alloy of any of clauses 1-5, wherein the alloy is essentially free of freckles.

Clause 7. The alloy of clause 6, wherein the alloy has a $G/\lambda_1^2$ value of at least 4000° C./cm$^3$, at 20% solidification of the alloy.

Clause 8. The alloy of clause 6, wherein the alloy has a $G/\lambda_1^2$ value of 4000° C./cm$^3$ to 20,000° C./cm$^3$ at 20% solidification of the alloy.

Clause 9. The alloy of clause 6, wherein the alloy has a reduction in liquid density of less than 0.015 g/cm$^3$ at 20% solidification of the alloy.

Clause 10. The alloy of clause 6, wherein the alloy has a reduction in liquid density of less than 0.025 g/cm$^3$ at 40% solidification of the alloy.

Clause 11. The alloy of any of clauses 1-5, wherein the alloy is essentially free of topologically close-packed phases.

Clause 12. The alloy of any of clauses 1-5, wherein the alloy has a γ' phase fraction of greater than 59% at 1000° C.

Clause 13. The alloy of any of clauses 1-5, wherein the alloy has a γ' phase fraction of greater than 45% after aging the alloy at 1150° C. for 30 hours.

Clause 14. The alloy of any of clauses 1-5, wherein the absolute value of the γ/γ' lattice misfit of the alloy is 0 to about 0.35% at 1000° C.

Clause 15. The alloy of clause 14, wherein the γ' precipitates have a cuboidal morphology.

Clause 16. The alloy of any of clauses 1-5, wherein the interfacial energy normalized coarsening rate constant is $7.0\times10^{-20}$ or less at 1000° C.

Clause 17. The alloy of any of clauses 1-5, wherein the alloy has a hardness of greater than 440 HV after aging.

Clause 18. The alloy of any of clauses 1-5, wherein the alloy has a Reed creep merit index of greater than 3.0.

Clause 19. The alloy of any of clauses 1-5, wherein the alloy has a Reed creep merit index of greater than 3.5.

Clause 20. The alloy of any of clauses 1-5, wherein the alloy has an ultimate tensile strength of at least 120 ksi at a temperature of 1800° F., as determined according to ASTM E8 and ASTM E21.

Clause 21. The alloy of any of clauses 1-5, wherein the alloy has a 0.2% offset yield strength of at least 90 ksi at a temperature of 1800° F., as determined according to ASTM E8 and ASTM E21.

Clause 22. The alloy of any of clauses 1-5, wherein the alloy has a modulus of elasticity of 10 Msi to 25 Msi at a temperature of 1800° F., as determined according to ASTM E8 and ASTM E21.

Clause 23. The alloy of any of clauses 1-5, wherein the alloy has a stress rupture life of no less than 200 hours at a temperature of 1900° F., as determined according to ASTM E139.

Clause 24. The alloy of any of clauses 1-23, wherein the alloy comprises about 5.9% aluminum.

Clause 25. The alloy of any of clauses 1-23, wherein the alloy comprises about 9% cobalt.

Clause 26. The alloy of any of clauses 1-23, wherein the alloy comprises about 7% chromium.

Clause 27. The alloy of any of clauses 1-23, wherein the alloy comprises about 0.1% hafnium.

Clause 28. The alloy of any of clauses 1-23, wherein the alloy comprises about 0.9% molybdenum.

Clause 29. The alloy of any of clauses 1-23, wherein the alloy comprises about 1% rhenium.

Clause 30. The alloy of any of clauses 1-23, wherein the alloy comprises about 9.5% tantalum.

Clause 31. The alloy of any of clauses 1-23, wherein the alloy comprises about 0.11% titanium.

Clause 32. The alloy of any of clauses 1-23, wherein the alloy comprises about 7.8% tungsten.

Clause 33. The alloy of any of clauses 1-23, wherein the alloy comprises, by weight, about 5.9% aluminum, about 9% cobalt, about 7% chromium, about 0.1% hafnium, about 0.9% molybdenum, about 1% rhenium, about 9.5% tantalum, about 0.11% titanium, and about 7.8% tungsten, the balance essentially nickel and incidental elements and impurities.

Clause 34. A method for producing an alloy comprising: preparing a melt that includes, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities.

Clause 35. A method for producing an alloy comprising: preparing a melt that includes, by weight, about 5% to about 7% aluminum, 0% to about 0.2% carbon, about 8% to about 10% cobalt, about 6% to about 8% chromium, about 0.01% to about 0.2% hafnium, about 0.5% to about 2% molybdenum, 0% to about 1.5% rhenium, about 8.5% to about 10.5% tantalum, about 0.01% to about 0.2% titanium, and about 7% to about 9% tungsten, the balance essentially nickel and incidental elements and impurities.

Clause 36. The method of clause 34 or 35, wherein the alloy comprises, by weight, about 5.5% to about 6.5% aluminum, about 8.5% to about 9.5% cobalt, about 6.5% to about 7.5% chromium, about 0.05% to about 0.15% hafnium, about 0.6% to about 1.2% molybdenum, about 0.8% to about 1.2% rhenium, about 9% to about 10% tantalum, about 0.05% to about 0.15% titanium, and about 7.5% to about 8.5% tungsten, the balance essentially nickel and incidental elements and impurities.

Clause 37. The method of any of clauses 34-36, wherein the alloy comprises, by weight, about 5.9% aluminum, about 9% cobalt, about 7% chromium, about 0.1% hafnium, about 0.9% molybdenum, about 1% rhenium, about 9.5% tantalum, about 0.11% titanium, and about 7.8% tungsten, the balance essentially nickel and incidental elements and impurities.

Clause 38. The method of any of clauses 34-37, wherein the melt is molded into a casting.

Clause 39. The method of clause 38, wherein the casting is homogenized after molding.

Clause 40. The method of clause 39, wherein the casting is homogenized by treatment for 2 hours at 1282° C., 2 hours at 1292° C., 6 hours at 1300° C., and 4 hours at 1305° C., with a heating rate of 0.5° C./second between each step; and cooling to room temperature in air.

Clause 41. The method of clause 40, wherein the casting is tempered by treatment for 4 hours at 1121° C. followed by 20 hours at 871° C.

Clause 42. The method of any of clauses 34-41, wherein the alloy is a single crystal.

Clause 43. The method of any of clauses 34-41, wherein the alloy is essentially free of freckles.

Clause 44. The method of clause 43, wherein the alloy has a $G/\lambda_1^2$ value of at least 4000° C./cm$^3$ at 20% solidification of the alloy.

Clause 45. The method of clause 43, wherein the alloy has a $G/\lambda_1^2$ value of 4000° C./cm$^3$ to 20,000° C./cm$^3$ at 20% solidification of the alloy.

Clause 46. The method of clause 43, wherein the alloy has a reduction in liquid density of less than 0.015 g/cm$^3$ at 20% solidification of the alloy.

Clause 47. The method of clause 43, wherein the alloy has a reduction in liquid density of less than 0.025 g/cm$^3$ at 40% solidification of the alloy.

Clause 48. The method of any of clauses 34-41, wherein the alloy is essentially free of topologically close-packed phases.

Clause 49. The method of any of clauses 34-41, wherein the alloy has a γ' phase fraction of greater than 59% at 1000° C.

Clause 50. The method of any of clauses 34-41, wherein the alloy has a γ' phase fraction of greater than 45% after aging the alloy at 1150° C. for 30 hours.

Clause 51. The method of any of clauses 34-41, wherein the absolute value of the γ/γ' lattice misfit of the alloy is 0 to about 0.35% at 1000° C.

Clause 52. The method of clause 51, wherein the γ' precipitates have a cuboidal morphology.

Clause 53. The method of any of clauses 34-41, wherein the interfacial energy normalized coarsening rate constant is $7.0\times10^{-20}$ or less at 1000° C.

Clause 54. The method of any of clauses 34-41, wherein the alloy has a hardness of greater than 440 HV after aging.

Clause 55. A manufactured article comprising an alloy that includes, by weight, about 4% to about 7% aluminum, 0% to about 0.2% carbon, about 7% to about 11% cobalt, about 5% to about 9% chromium, about 0.01% to about 0.2% hafnium, about 0.5% to about 2% molybdenum, 0% to about 1.5% rhenium, about 8% to about 10.5% tantalum, about 0.01% to about 0.5% titanium, and about 6% to about 10% tungsten, the balance essentially nickel and incidental elements and impurities.

Clause 56. A manufactured article comprising an alloy that includes, by weight, about 5% to about 7% aluminum, 0% to about 0.2% carbon, about 8% to about 10% cobalt, about 6% to about 8% chromium, about 0.01% to about 0.2% hafnium, about 0.5% to about 2% molybdenum, 0% to about 1.5% rhenium, about 8.5% to about 10.5% tantalum, about 0.01% to about 0.2% titanium, and about 7% to about 9% tungsten, the balance essentially nickel and incidental elements and impurities.

Clause 57. The article of clause 55 or 56, wherein the alloy comprises, by weight, about 5.5% to about 6.5% aluminum, about 8.5% to about 9.5% cobalt, about 6.5% to about 7.5% chromium, about 0.05% to about 0.15% hafnium, about 0.6% to about 1.2% molybdenum, about 0.8% to about 1.2% rhenium, about 9% to about 10% tantalum, about 0.05% to about 0.15% titanium, and about 7.5% to about 8.5% tungsten, the balance essentially nickel and incidental elements and impurities.

Clause 58. The article of any of clauses 55-57, wherein the alloy comprises, by weight, about 5.9% aluminum, about 9% cobalt, about 7% chromium, about 0.1% hafnium, about 0.9% molybdenum, about 1% rhenium, about 9.5% tantalum, about 0.11% titanium, and about 7.8% tungsten, the balance essentially nickel and incidental elements and impurities.

Clause 59. The article of any of clauses 55-58, wherein the alloy is in the form of a casting.

Clause 60. The article of any of clauses 55-58, wherein the alloy is a single crystal.

Clause 61. The article of any of clauses 55-58, wherein the alloy is essentially free of freckles.

Clause 62. The article of clause 61, wherein the alloy has a $G/\lambda_1^2$ value of at least 4000° C./cm$^3$ at 20% solidification of the alloy.

Clause 63. The article of clause 61, wherein the alloy has a $G/\lambda_1^2$ value of 4000° C./cm$^3$ to 20,000° C./cm$^3$ at 20% solidification of the alloy.

Clause 64. The article of clause 61, wherein the alloy has a reduction in liquid density of less than 0.015 g/cm$^3$ at 20% solidification of the alloy.

Clause 65. The article of clause 61, wherein the alloy has a reduction in liquid density of less than 0.025 g/cm$^3$ at 40% solidification of the alloy.

Clause 66. The article of any of clauses 55-58, wherein the alloy is essentially free of topologically close-packed phases.

Clause 67. The article of any of clauses 55-58, wherein the alloy has a γ' phase fraction of greater than 59% at 1000° C.

Clause 68. The article of any of clauses 55-58, wherein the alloy has a γ' phase fraction of greater than 45% after aging the alloy at 1150° C. for 30 hours.

Clause 69. The article of any of clauses 55-58, wherein the absolute value of the γ/γ' lattice misfit of the alloy is 0 to about 0.35% at 1000° C.

Clause 70. The article of clause 69, wherein the γ' precipitates have a cuboidal morphology.

Clause 71. The article of any of clauses 55-58, wherein the interfacial energy normalized coarsening rate constant is $7.0\times10^{-20}$ or less at 1000° C.

Clause 72. The article of any of clauses 55-58, wherein the alloy has a hardness of greater than 440 HV after aging.

Clause 73. The article of any of clauses 55-58, wherein the article is a blade.

Clause 74. The article of clause 73, wherein the blade is the blade of an industrial gas turbine.

Clause 75. The article of clause 73, wherein the blade is used in an aerospace application.

What is claimed is:

1. An alloy consisting of by weight, 5.5% to 6.5% aluminum, 0% to 0.2% carbon, 8.5% to 9.5% cobalt, 6.5% to 7.5% chromium, 0.05% to 0.15% hafnium, 0.6% to 1.2% molybdenum, 0.8% to 1.2 rhenium, 9% to 10% tantalum, 0.05% to 0.15% titanium, 7.5% to 8.5% tungsten, 0% to 0.5% lanthanum, 0% to 0.5% yttrium, and 0% to 0.5% boron the balance nickel and incidental impurity elements, wherein the alloy is a single crystal; and wherein the alloy has a reduction in liquid density of less than 0.025 g/cm3 at 40% solidification of the alloy.

2. The alloy of claim 1, wherein the alloy has a reduction in liquid density of less than 0.015 g/cm$^3$ at 20% solidification of the alloy.

3. The alloy of claim 1, wherein the alloy is essentially free of freckles.

4. The alloy of claim 1, wherein the alloy is essentially free of topologically close-packed phases.

5. The alloy of claim 1, wherein the alloy has a γ' phase fraction of greater than 59% at 1000° C.

6. The alloy of claim 1, wherein the alloy has a γ' phase fraction of greater than 45% after aging the alloy at 1150° C. for 30 hours.

7. The alloy of claim 1, wherein the absolute value of the γ/γ' lattice misfit of the alloy is 0 to 0.35% at 1000° C.

8. The alloy of claim 7, wherein the γ' precipitates have a cuboidal morphology.

9. The alloy of claim 1, wherein the interfacial energy normalized coarsening rate constant is $7.0\times10^{-20}$ or less at 1000° C.

10. The alloy of claim 1, wherein the alloy has a hardness of greater than 440 HV after aging.

11. The alloy of claim 1, wherein the alloy consists of, by weight: 5.9% aluminum, 9% cobalt, 7% chromium, 0.1% hafnium, 0.9% molybdenum, 1% rhenium, 9.5% tantalum, 0.11% titanium, and 7.8% tungsten, the balance nickel and incidental impurity elements.

12. A method for producing an alloy comprising:

preparing a melt that consists of, by weight, 5.5% to 6.5% aluminum, 0% to 0.2% carbon, 8.5% to 9.5% cobalt, 6.5% to 7.5% chromium, 0.05% to 0.15% hafnium, 0.6% to 1.2% molybdenum, 0.8% to 1.2 rhenium, 9% to 10% tantalum, 0.05% to 0.15% titanium, 7.5% to 8.5% tungsten, 0% to 0.5% lanthanum, 0% to 0.5% yttrium, and 0% to 0.5% boron, the balance nickel and incidental impurity elements wherein the alloy is a single crystal; and wherein the alloy has a reduction in liquid density of less than 0.025 g/cm3 at 40% solidification of the alloy.

13. The method of claim 12, wherein the melt is molded into a casting, wherein the casting is homogenized by treatment for 2 hours at 1282° C., 2 hours at 1292° C., 6 hours at 1300° C., and 4 hours at 1305° C., with a heating rate of 0.5° C./second between each step; and cooling to room temperature in air.

14. The method of claim 13, wherein the casting is tempered by treatment for 4 hours at 1121° C. followed by 20 hours at 871° C.

15. A manufactured article comprising an alloy that consists of, by weight, 5.5% to 6.5% aluminum, 0% to 0.2% carbon, 8.5% to 9.5% cobalt, 6.5% to 7.5% chromium, 0.05% to 0.15% hafnium, 0.6% to 1.2% molybdenum, 0.8% to 1.2 rhenium, 9% to 10% tantalum, 0.05% to 0.15% titanium, 7.5% to 8.5% tungsten, 0% to 0.5% lanthanum, 0% to 0.5% yttrium, and 0% to 0.5% boron the balance nickel and incidental impurity elements wherein the alloy is a single crystal; and wherein the alloy has a reduction in liquid density of less than 0.025 g/cm3 at 40% solidification of the alloy.

16. The article of claim 15, wherein the article is the blade of an industrial gas turbine or a blade used in an aerospace application.

* * * * *